US012345033B2

(12) United States Patent
Tsai

(10) Patent No.: US 12,345,033 B2
(45) Date of Patent: Jul. 1, 2025

(54) VORTEX FLUSH TOILET

(71) Applicant: Global One Tech Corporation, Taichung (TW)

(72) Inventor: Tien-Shou Tsai, Taichung (TW)

(73) Assignee: GLOBAL ONE TECH CORPORATION, Taichung (TW)

( * ) Notice: Subject to any disclaimer, the term of this patent is extended or adjusted under 35 U.S.C. 154(b) by 132 days.

(21) Appl. No.: 18/500,848

(22) Filed: Nov. 2, 2023

(65) Prior Publication Data

US 2024/0151021 A1 May 9, 2024

(30) Foreign Application Priority Data

Nov. 8, 2022 (TW) ..... 111142517

(51) Int. Cl.
*E03D 11/08* (2006.01)
*E03D 1/32* (2006.01)
*E03D 1/34* (2006.01)

(52) U.S. Cl.
CPC ..... *E03D 11/08* (2013.01); *E03D 1/32* (2013.01); *E03D 1/34* (2013.01); *E03D 2201/40* (2013.01)

(58) Field of Classification Search
CPC .. E03D 11/08; E03D 1/32; E03D 1/34; E03D 2201/40
USPC ..... 4/420, 300, 256.1, 901, 905
See application file for complete search history.

(56) References Cited

U.S. PATENT DOCUMENTS 4,145,772 A * 3/1979 Whitney ..... E03D 1/286 4/300
4,185,337 A * 1/1980 Sargent ..... E03D 5/01 4/300
4,185,340 A * 1/1980 Sargent ..... E03D 5/09 4/300

(Continued)

FOREIGN PATENT DOCUMENTS

CA 2758862 A1 * 5/2012 ..... E03D 11/08
CA 3074606 A1 * 9/2020 ..... E03D 1/00

(Continued)

OTHER PUBLICATIONS

Search Report appended to an Office Action, which was issued to Taiwanese counterpart application No. 111142517 by the TIPO on Mar. 15, 2023, with an English translation thereof, 2 pages.

*Primary Examiner* — Lori L Baker
(74) *Attorney, Agent, or Firm* — HSML P.C.

(57) ABSTRACT

A vortex flush toilet includes a toilet stool including a toilet bowl and a rim unit, a water tank unit, a first water discharge unit, a pipe unit, an electric switching valve, and a sensor control unit controlling switching of the electric switching valve between a blocked state and a communicated state. The rim unit is formed with first, second, and third flushing ports having decreasing sectional area, and has first, second, and third water-guiding passages respectively in fluid communication with the first, second, and third flushing ports and each having a width decreasing gradually. A bottom surface of each of the first, second, and third water-guiding passages has a height decreasing gradually and forms a respective one of first, second, and third height differences increasing gradually. An inclination angle defined between the bottom surface of each first, second, and third water-guiding passage and a horizontal line gradually increases.

8 Claims, 24 Drawing Sheets

(56) References Cited

U.S. PATENT DOCUMENTS 4,246,227 A * 1/1981 Crosby ..... B29C 49/04112 425/525
4,908,886 A * 3/1990 Barrett, Sr ..... G05D 27/02 4/300
5,335,379 A * 8/1994 Waldo ..... A47K 17/00 4/231
5,596,774 A * 1/1997 Howard ..... E03D 9/00 4/233
5,918,325 A * 7/1999 Arita ..... E03D 11/02 4/420
6,115,853 A * 9/2000 Shibata ..... E03D 11/08 4/420
6,332,229 B1 * 12/2001 O'Malley ..... E03D 5/08 4/441
6,415,457 B2 * 7/2002 Schmucki ..... E03D 11/06 4/421
9,021,622 B2 * 5/2015 Kitaura ..... E03D 11/08 4/425
2004/0040076 A1 * 3/2004 Han ..... E03D 11/08 4/300
2004/0040080 A1 * 3/2004 Prokopenko ..... E03D 11/02 4/420
2006/0005310 A1 * 1/2006 Nakamura ..... E03D 11/08 4/420
2007/0199138 A1 * 8/2007 Zhurin ..... E03D 9/00 4/300
2008/0276361 A1 * 11/2008 Mueller ..... E03D 11/08 4/420
2010/0146693 A1 * 6/2010 Yamaguchi ..... E03D 5/10 4/420
2010/0242162 A1 * 9/2010 Moon ..... E03D 11/11 4/420
2011/0168281 A1 * 7/2011 Garza ..... F16K 11/00 4/420
2012/0144572 A1 * 6/2012 Bush ..... E03D 11/08 4/420
2014/0109307 A1 * 4/2014 Kitaura ..... E03D 11/08 4/329
2014/0259351 A1 * 9/2014 Spankowski ..... E03D 11/14 4/420
2015/0013058 A1 * 1/2015 Bucher ..... E03D 9/037 4/224
2015/0107011 A1 * 4/2015 Bucher ..... E03D 11/14 4/420
2017/0030065 A1 * 2/2017 Bucher ..... E03D 9/032
2018/0080208 A1 * 3/2018 Hashimoto ..... E03D 11/08
2023/0183963 A1 * 6/2023 Schibur ..... E03D 11/13 4/420

FOREIGN PATENT DOCUMENTS

CN 107709676 A * 2/2018 ..... E03D 11/08
CN 108396840 A * 8/2018 ..... E03D 11/02
CN 111287280 B * 11/2021 ..... E03D 1/30
CN 114941360 A * 8/2022
CN 118814926 A * 10/2024 ..... E03D 11/08
EP 352712 A * 1/1990 ..... E03D 5/00
EP 3486384 A1 * 5/2019 ..... E03D 11/02
TW 201814112 A 4/2018
TW 595142 U * 5/2020
TW M595142 U 5/2020
TW 830487 B1 * 1/2024 ..... E03D 1/32
WO WO-2008024005 A2 * 2/2008 ..... A47K 10/32
WO WO-2008026880 A1 * 3/2008 ..... E03C 1/298
WO WO-2008136909 A1 * 11/2008 ..... E03D 11/08
WO WO-2017062968 A1 * 4/2017 ..... E03D 1/012
WO WO-2019165886 A1 * 9/2019 ..... E03D 11/02

* cited by examiner

VORTEX FLUSH TOILET

CROSS-REFERENCE TO RELATED APPLICATION

This application claims priority to Taiwanese Invention Patent Application No. 111142517, filed on Nov. 8, 2022, which is incorporated by reference herein in its entirety.

FIELD

The disclosure relates to a flush toilet, and more particularly to a vortex flush toilet.

BACKGROUND

Referring to FIGS. 1 and 2, a conventional flush toilet 1 generally includes a toilet rim 101 having a rectangular cross section in a vertical direction at a top portion thereof. The toilet rim 101 defines an annular water passage 102 therein, and is formed with a plurality of water spout holes 103 in a bottom surface thereof for discharging water to a bowl surface 104 of the conventional flush toilet 1.

However, water discharged from the water spout holes 103 may not thoroughly flush the bottom surface of the toilet rim 101 and a junction between the bottom surface and the bowl surface 104, thereby leaving residues of excreta in the conventional flush toilet 1.

Another conventional flush toilet, e.g., disclosed in Taiwanese Invention Patent No. I649482, includes a toilet bowl formed with a plurality of spout ports at an upper portion thereof for discharging water to induce a horizontal circulating flow by the discharge of water in a horizontal direction. However, a water guiding passage defined by the upper portion of the toilet bowl is generally leveled, i.e., a starting end and an ending end of the water guiding passage have the same height; flushing force may decrease downstream of the water guiding passage, thereby reducing flushing effect of the conventional flush toilet.

In addition, to flush the excreta away from a conventional flush toilet, a user normally needs to press a button or turn a handle that is disposed on a water tank. In a case where the user forgets to flush the toilet, a hygienic environment may not be available for subsequent users.

SUMMARY

Therefore, an object of the disclosure is to provide a vortex flush toilet that can alleviate at least one of the drawbacks of the prior art.

According to the disclosure, a vortex flush toilet includes a toilet stool, a water tank unit, a first water discharge unit, a pipe unit, an electric switching valve, and a sensor control unit. The toilet stool includes a toilet bowl, a draining pipe, a rim unit, and a water supply. The toilet bowl has a bowl surface that defines a bowl space and that has a front region, a rear region disposed behind the front region, and two lateral regions each interconnecting the front region and the rear region. The draining pipe is connected to a lower portion of the toilet bowl. The rim unit is connected to an upper portion of the toilet bowl, and is formed with a first flushing port that is adjacent to one of the lateral regions, a second flushing port that is adjacent to another one of the lateral regions, and a third flushing port that is adjacent to the rear region. The first flushing port has a sectional area in a height direction greater than a sectional area of the second flushing port in the height direction. The sectional area of the second flushing port in the height direction is greater than a sectional area of the third flushing port in the height direction. The rim unit has a first water-guiding passage, a second water-guiding passage, a third water-guiding passage, a first water-guiding surface, a second water-guiding surface, and a third water-guiding surface. The first water-guiding passage is in fluid communication with the first flushing port, has a first starting end and a first ending end disposed downstream of the first starting end, extends from the one of the lateral regions through the front region to the another one of the lateral regions, has a width in a radial direction transverse to the height direction decreasing gradually from the first starting end to the first ending end, and is adapted to guide water flowing into the bowl space to cover at least 70% of an area of the bowl surface. The second water-guiding passage is in fluid communication with the second flushing port, is disposed downstream of the first water-guiding passage, has a second starting end and a second ending end disposed downstream of the second starting end, extends from the another one of the lateral regions to the rear region, has a width in the radial direction decreasing gradually from the second starting end to the second ending end, and is adapted to guide water flowing into the bowl space to cover at least 20% of the area of the bowl surface. The third water-guiding passage is in fluid communication with the third flushing port, is disposed downstream of the second water-guiding passage, has a third starting end and a third ending end disposed downstream of the third starting end, extends from the rear region to the one of the lateral regions, has a width in the radial direction decreasing gradually from the third starting end to the third ending end, and is adapted to guide water flowing into the bowl space to cover at least 40% of the area of the bowl surface. The first water-guiding surface defines a bottom surface of the first water-guiding passage, and has a height in the height direction decreasing gradually from the first starting end to the first ending end. A minimum distance between the first starting end and the first ending end in the height direction is a first height difference. A first inclination angle defined between the first water-guiding surface and a horizontal line that is transverse to the height direction increases gradually from the first starting end to the first ending end. A first angle difference is defined between the first starting end and the first ending end. The second water-guiding surface defines a bottom surface of the second water-guiding passage, and has a height in the height direction decreasing gradually from the second starting end to the second ending end. A minimum distance between the second starting end and the second ending end in the height direction is a second height difference that is greater than the first height difference. A second inclination angle defined between the second water-guiding surface and the horizontal line increases gradually from the second starting end to the second ending end. A second angle difference is defined between the second starting end and the second ending end, and is greater than the first angle difference. The third water-guiding surface defines a bottom surface of the third water-guiding passage, and has a height in the height direction decreasing gradually from the third starting end to the third ending end. A minimum distance between the third starting end and the third ending end in the height direction is a third height difference that is greater than the second height difference. A third inclination angle of the third water-guiding surface relative to the horizontal line increases gradually from the third starting end to the third ending end. A third angle difference is defined between the third starting end and the third ending end, and is greater than the second angle difference. The water supply defines a water chamber that is in fluid communication with the first flushing port, the second flushing port and the third flushing port, and has a water inlet that is in fluid communication with the water chamber. The water tank unit includes a tank body defining a water storage space therein. The first water discharge unit is disposed in the tank body and defines a first discharging hole disposed downstream of the water storage space. The pipe unit includes a flow-out pipe and a first flow-in pipe. The flow-out pipe is in fluid communication with the water inlet of the water supply and is disposed upstream of the bowl space. The first flow-in pipe is connected to the first water discharge unit and is disposed downstream of the first discharging hole. The electric switching valve is connected in series between the flow-out pipe and the first flow-in pipe, and is switchable between a blocked state, where fluid communication between the flow-out pipe and the first flow-in pipe is blocked, and a communicated state, where the flow-out pipe and the first flow-in pipe are fluidly communicated with each other. The sensor control unit is disposed for controlling switching of the electric switching valve between the blocked state and the communicated state.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
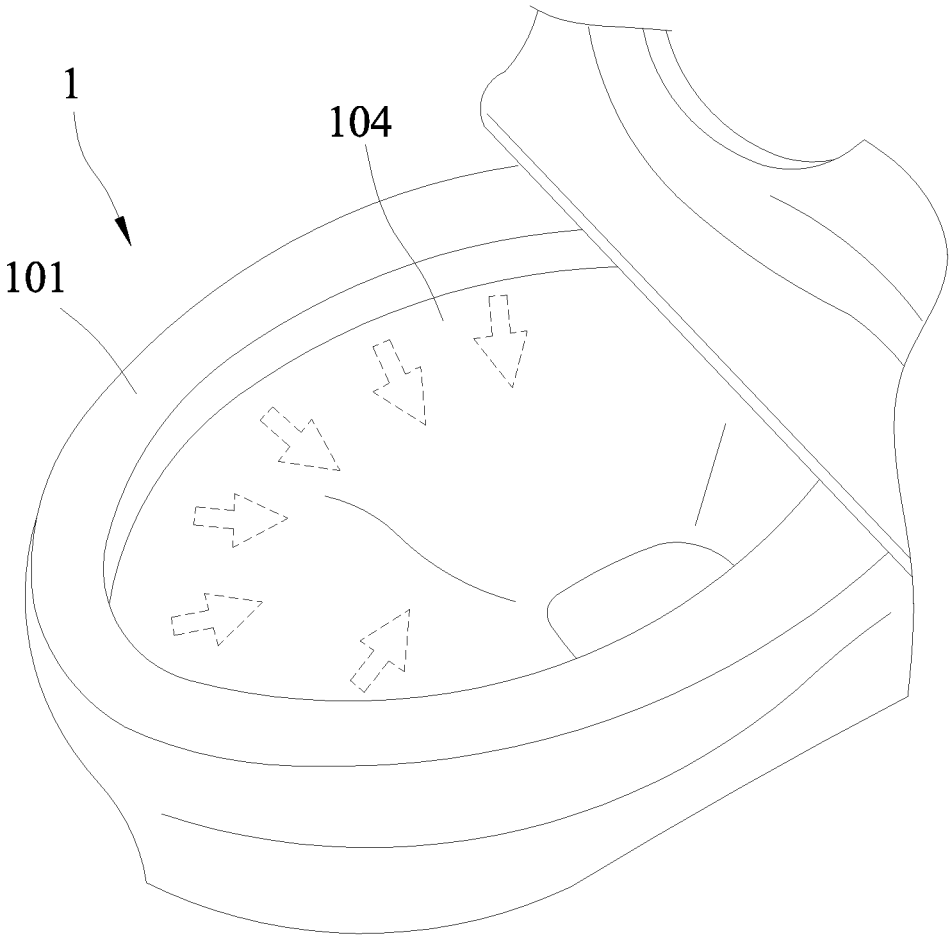
FIG. 1 PRIOR ART
FIG. 1 is a schematic fragmentary perspective view of a conventional flush toilet, illustrating directions of water flow generated thereby.
Figure 2:
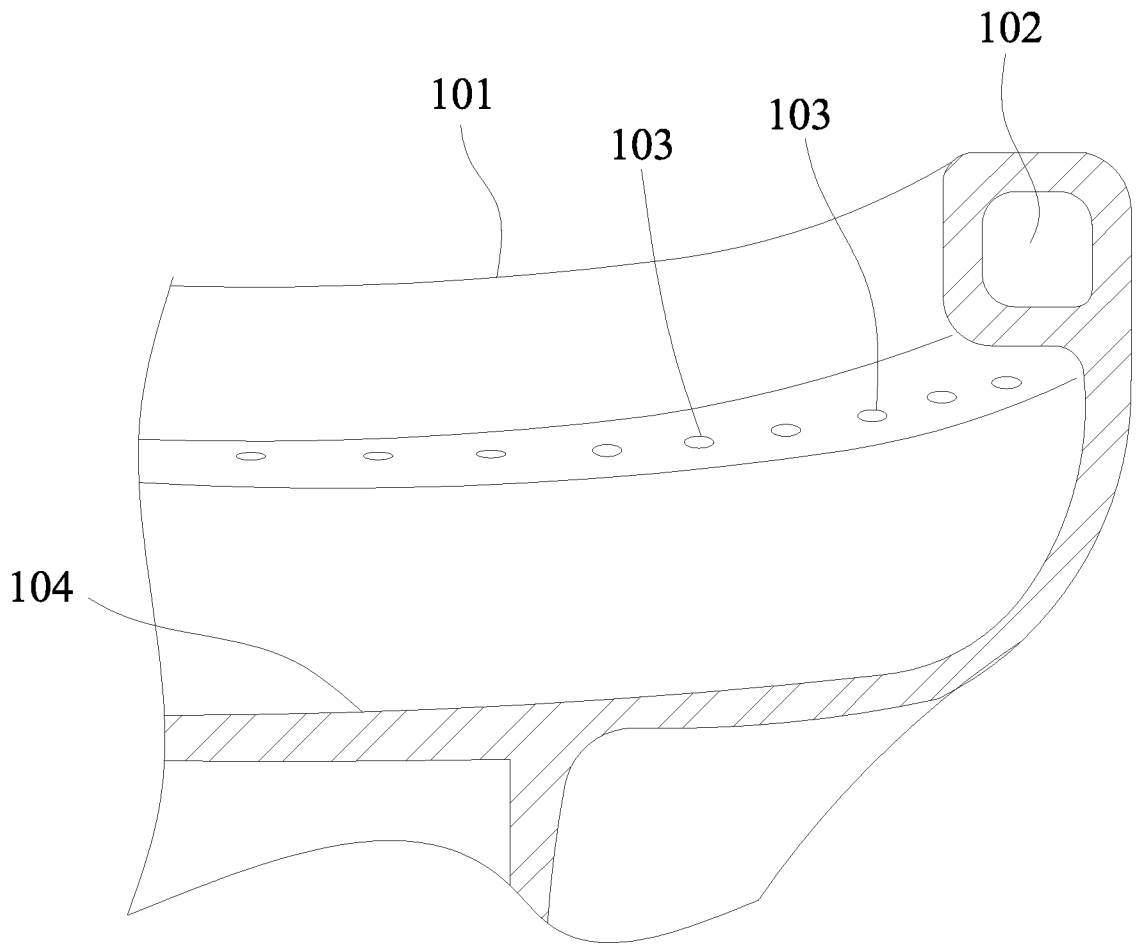
FIG. 2 PRIOR ART
FIG. 2 is a fragmentary sectional view of the conventional flush toilet.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently e.g., rotated 90 degrees or at other orientations and the spatially relative terms used herein may be interpreted accordingly.

Figure 3:
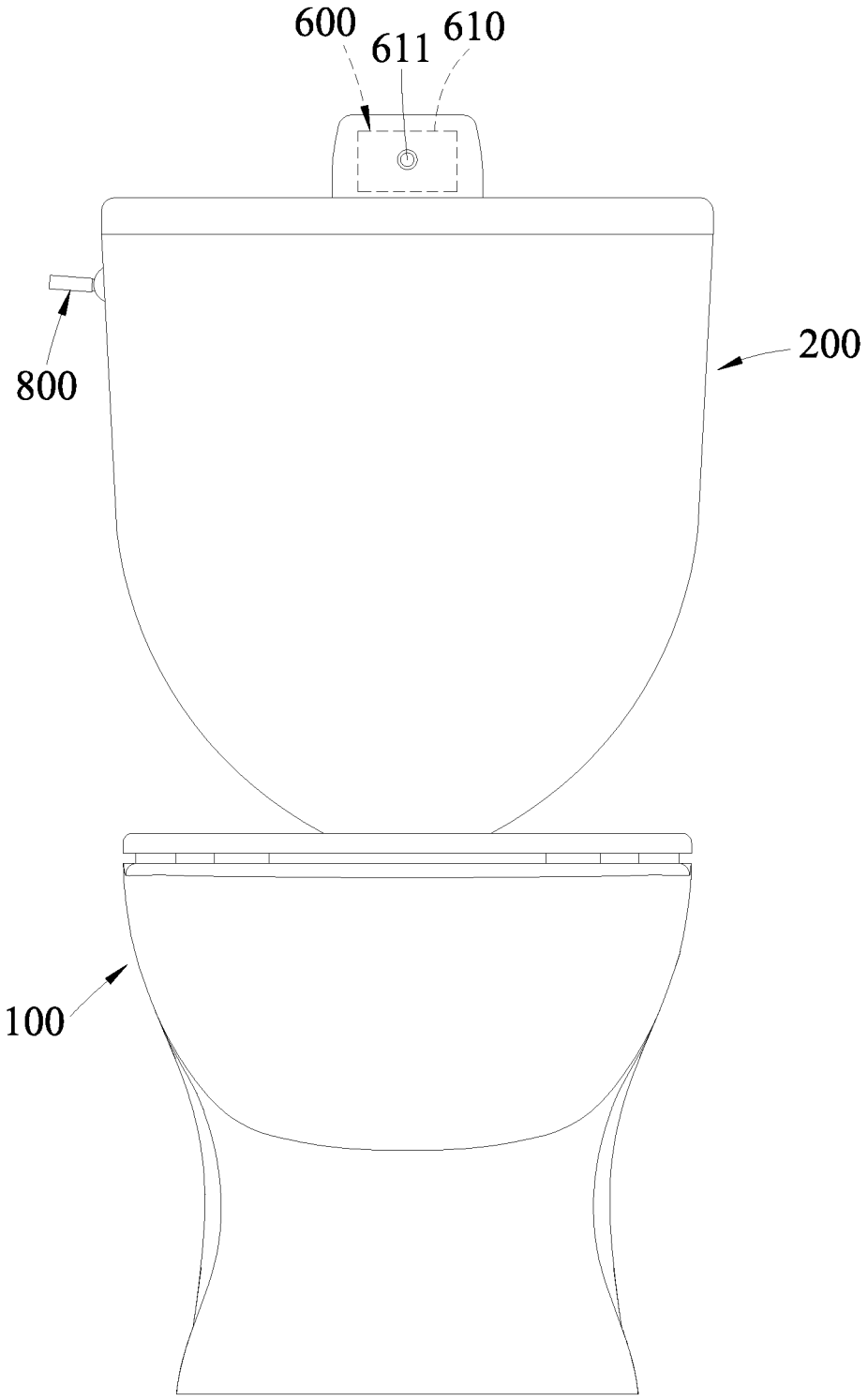
FIG. 3 is a schematic front view of a vortex flush toilet of an embodiment according to the present disclosure.
Figure 4:
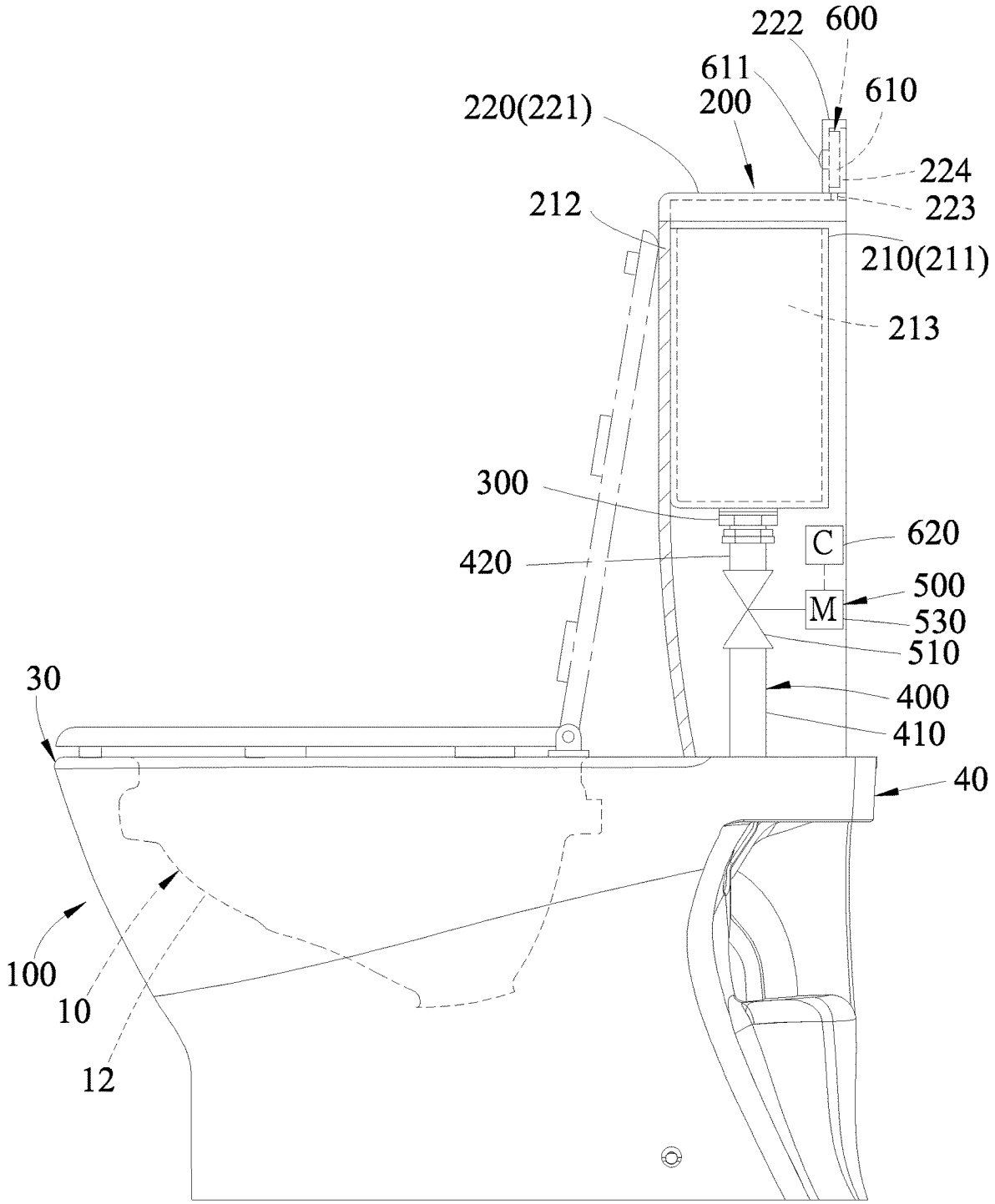
FIG. 4 is a schematic partly sectional view of the embodiment.
Figure 5:
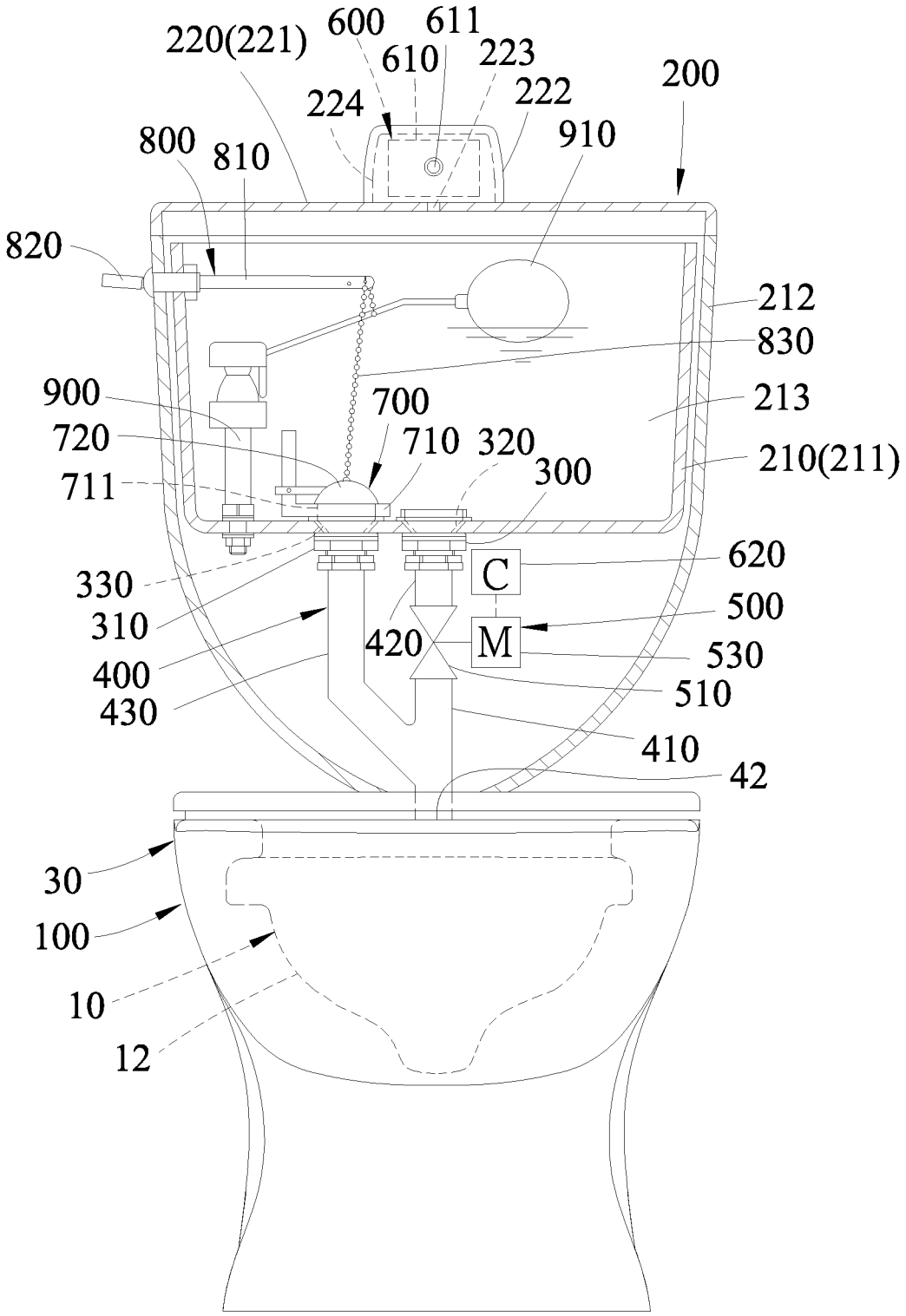
FIG. 5 is a schematic partly sectional front view of the embodiment.

Referring to FIGS. 3 to 5, a vortex flush toilet of an embodiment according to the present disclosure is shown. The vortex flush toilet includes a toilet stool 100, a water tank unit 200, a first water discharge unit 300, a second water discharge unit 310, a pipe unit 400, an electric switching valve 500, a sensor control unit 600, a flush valve 700, a manual actuating unit 800, a water inlet valve 900, and a float ball 910.

Figure 6:
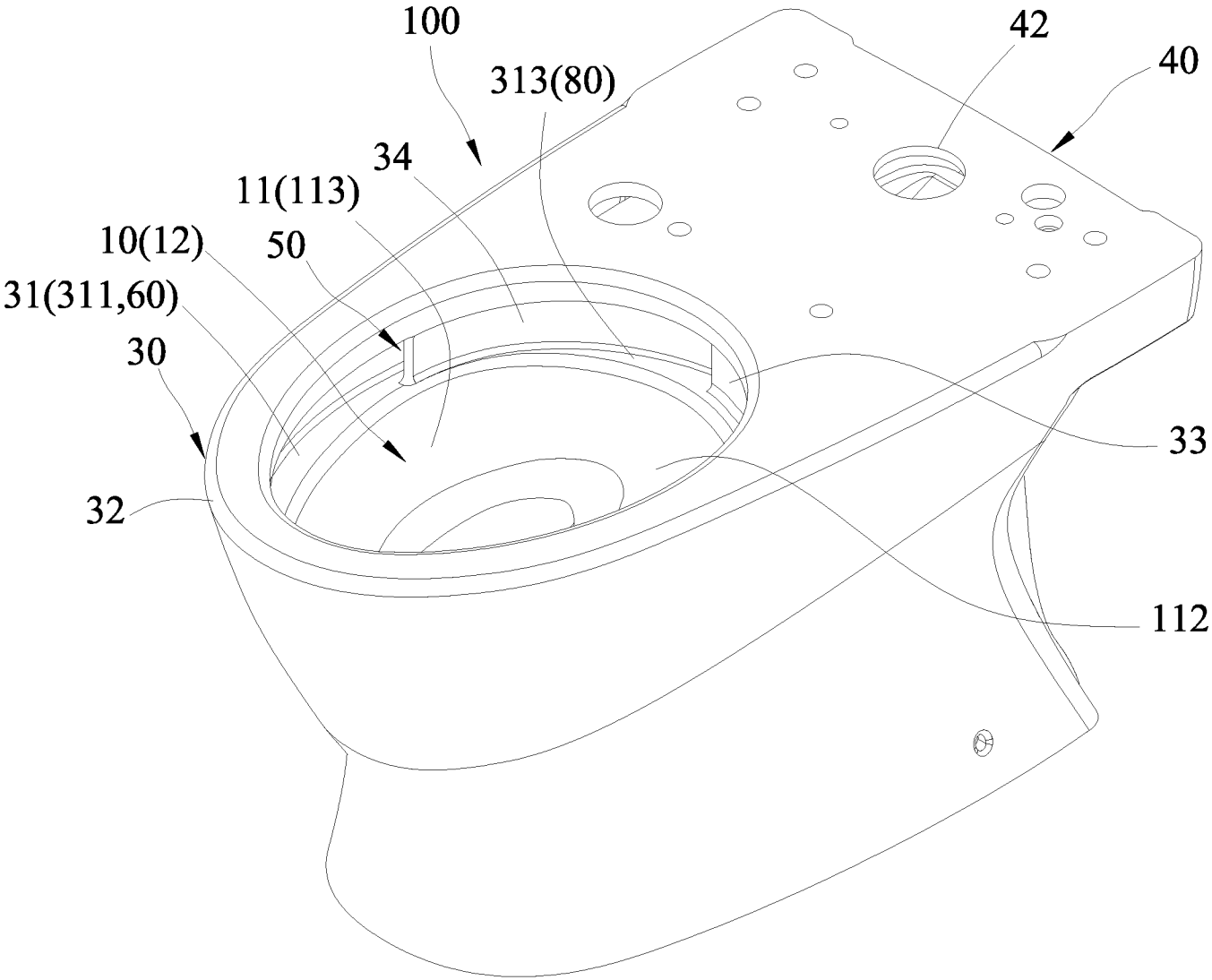
FIG. 6 is a perspective view of a toilet stool of the vortex flush toilet of the embodiment.
Figure 7:
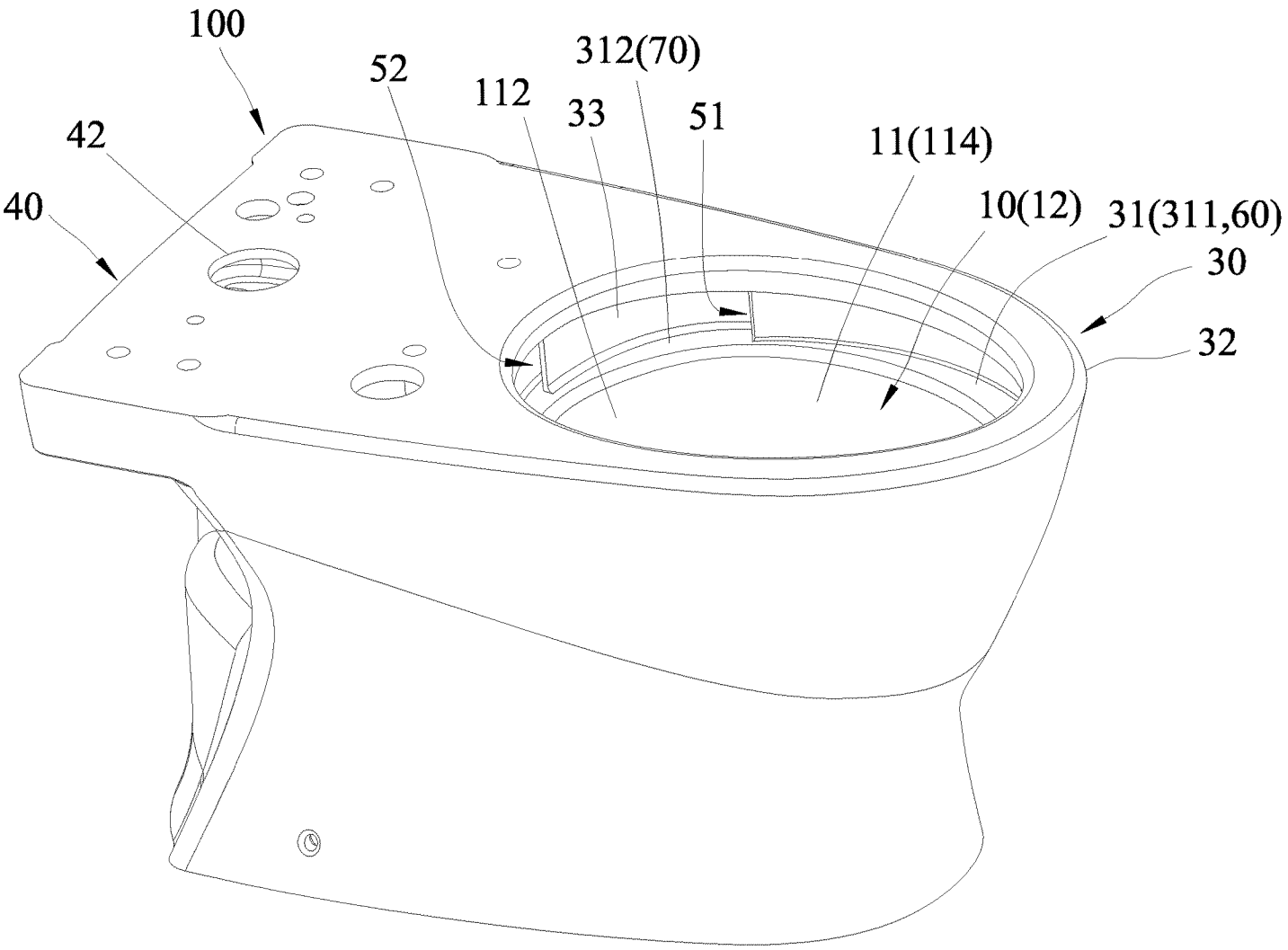
FIG. 7 is a perspective view similar to FIG. 6, but seen from another view of angle different from FIG. 6.
Figure 8:
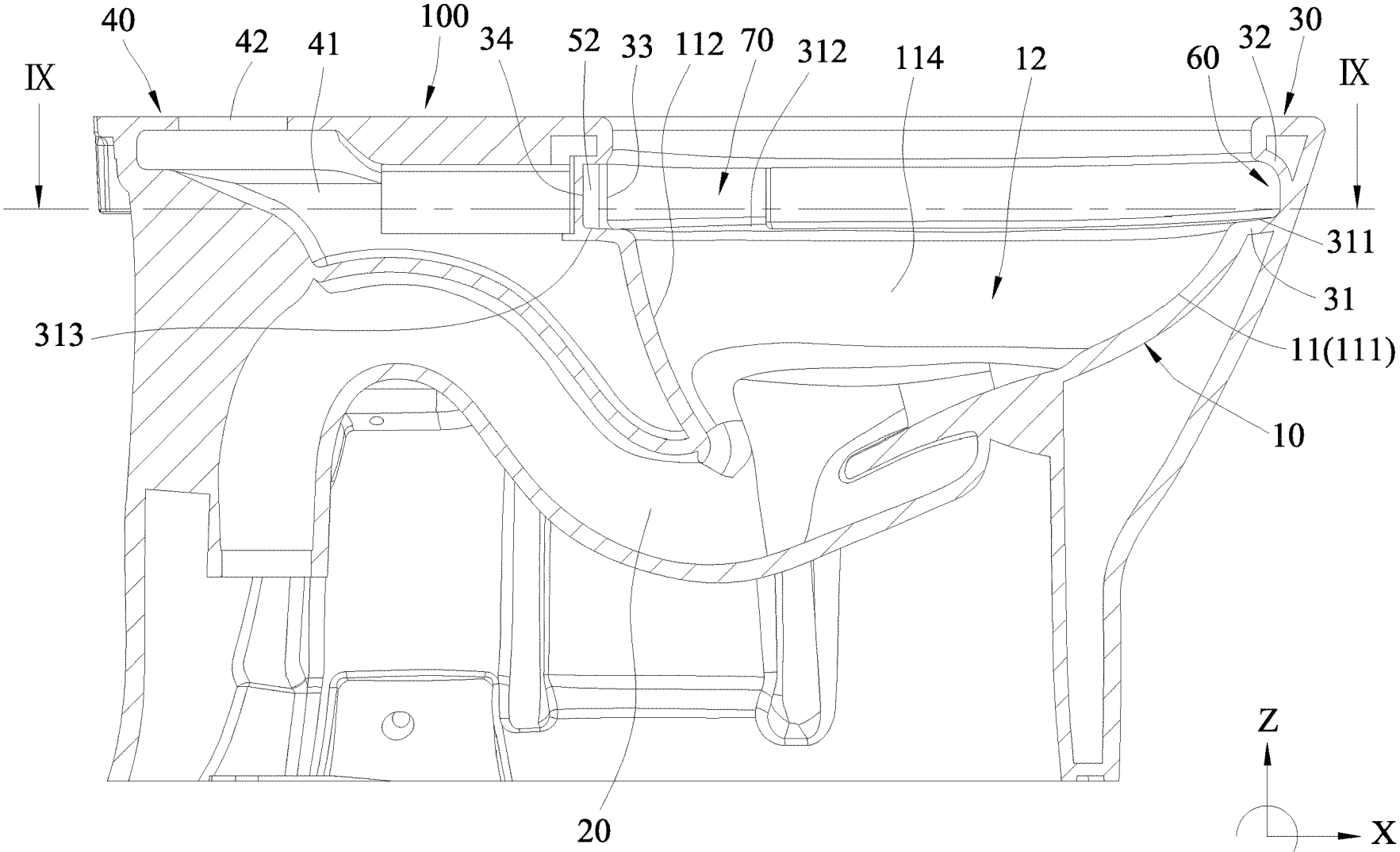
FIG. 8 is a sectional view of the embodiment.

Further referring to FIGS. 6 to 8, the toilet stool 100 includes a toilet bowl 10, a draining pipe 20, a rim unit 30, and a water supply 40.

Figure 9:
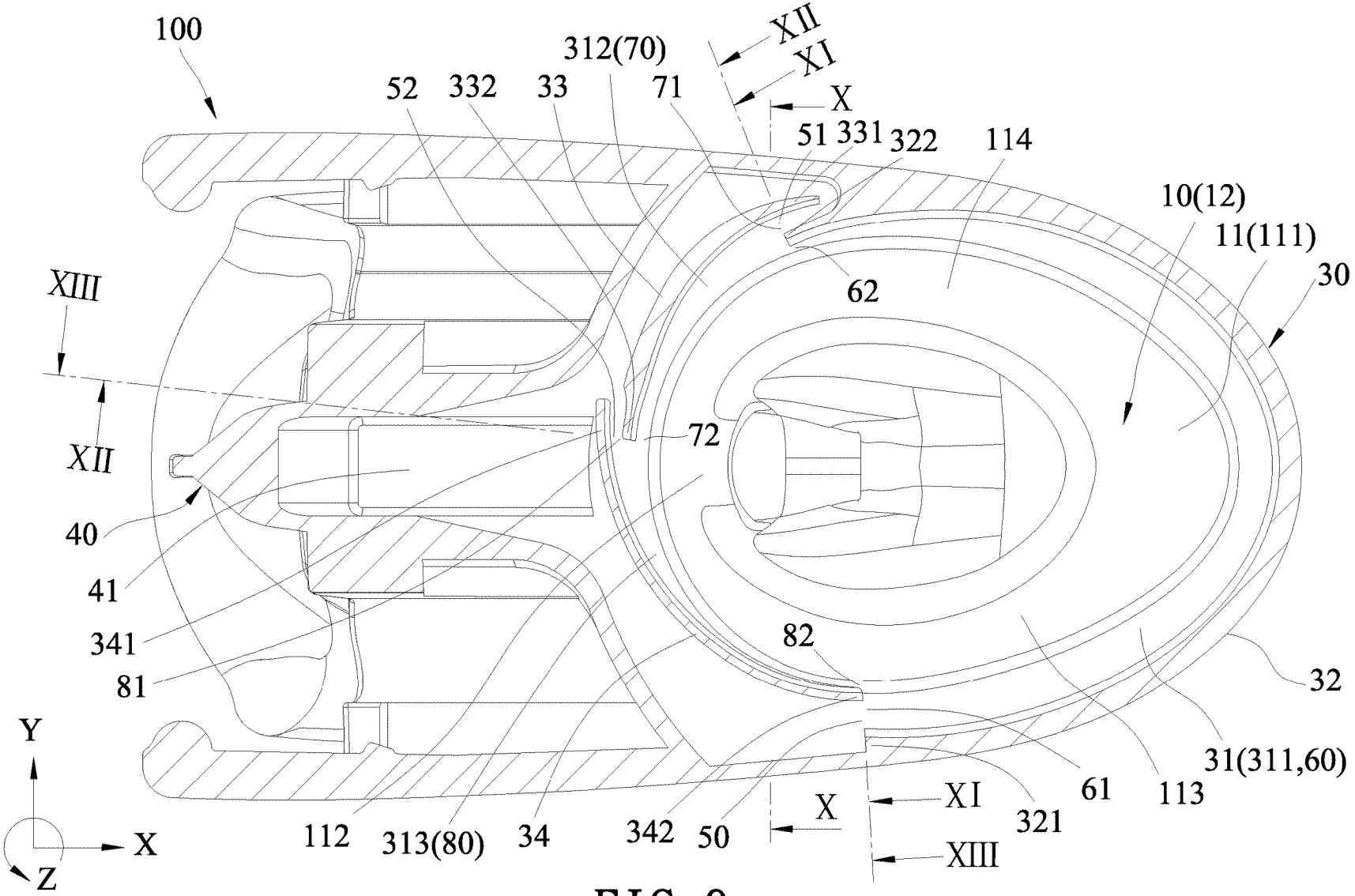
FIG. 9 is a cross-sectional view taken along line IX-IX in FIG. 8.
Figure 10:
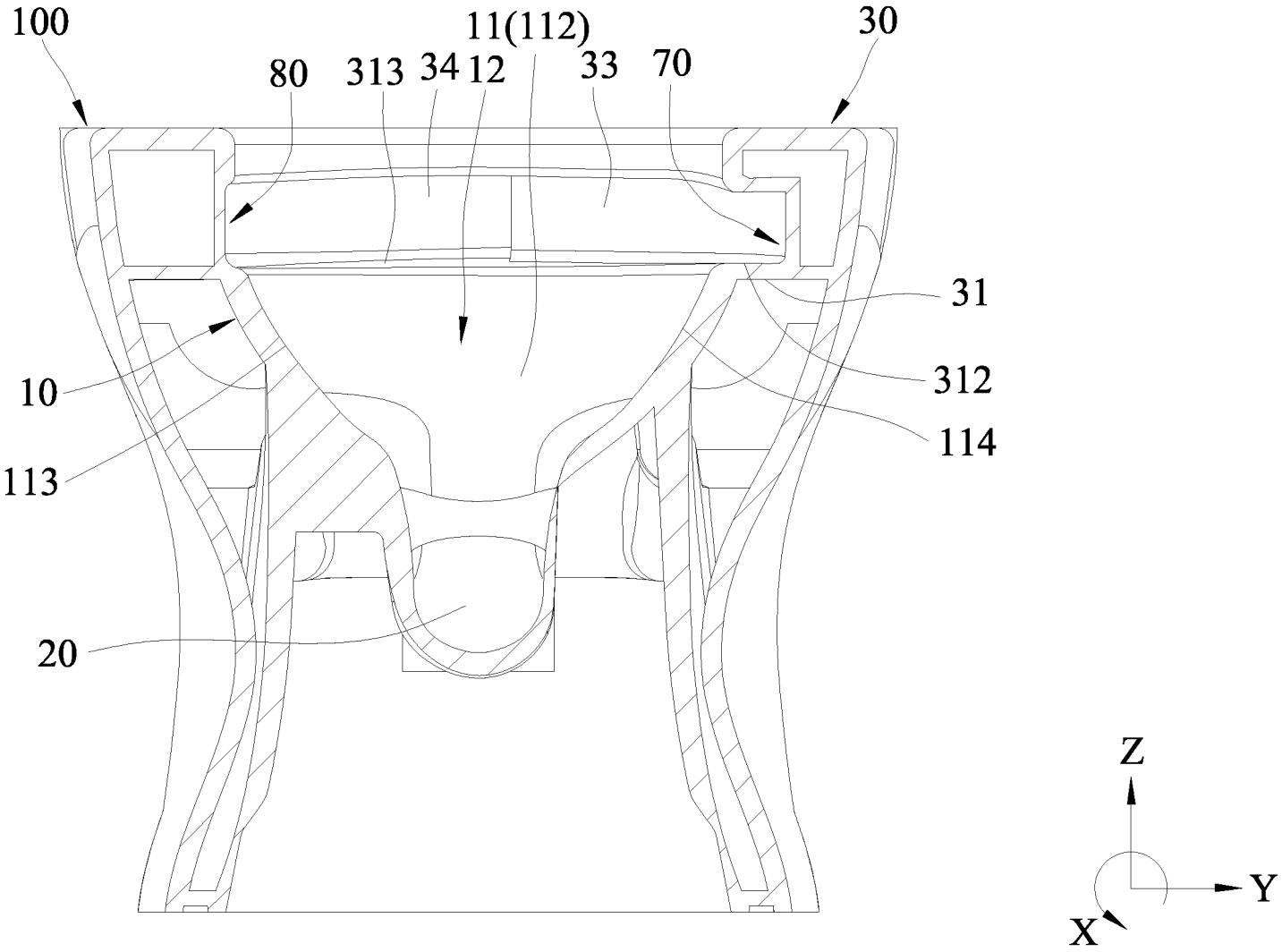
FIG. 10 is a sectional view taken along line X-X in FIG. 9.
Figure 11:
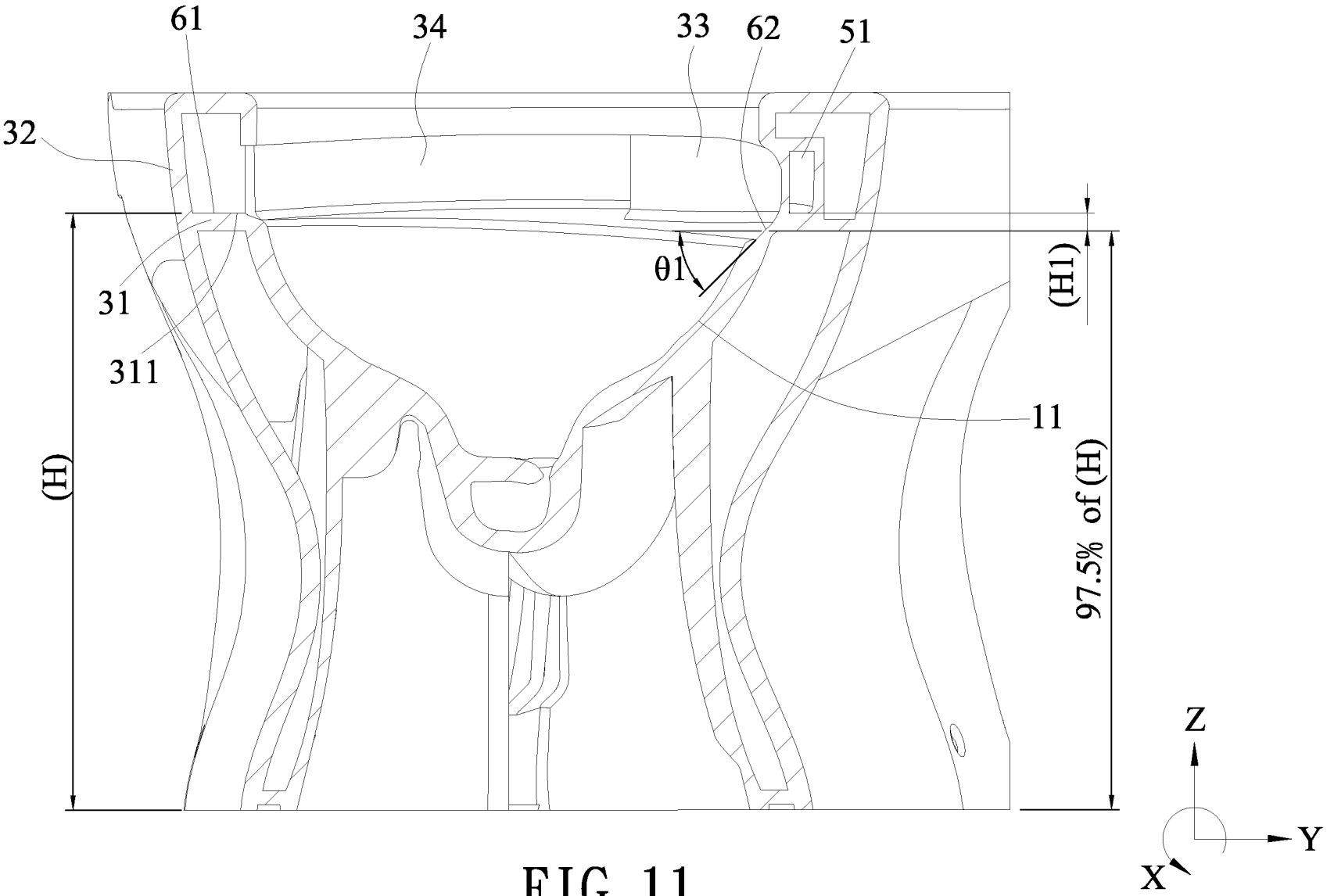
FIG. 11 is an offset sectional view taken along line XI-XI in FIG. 9.
Figure 12:
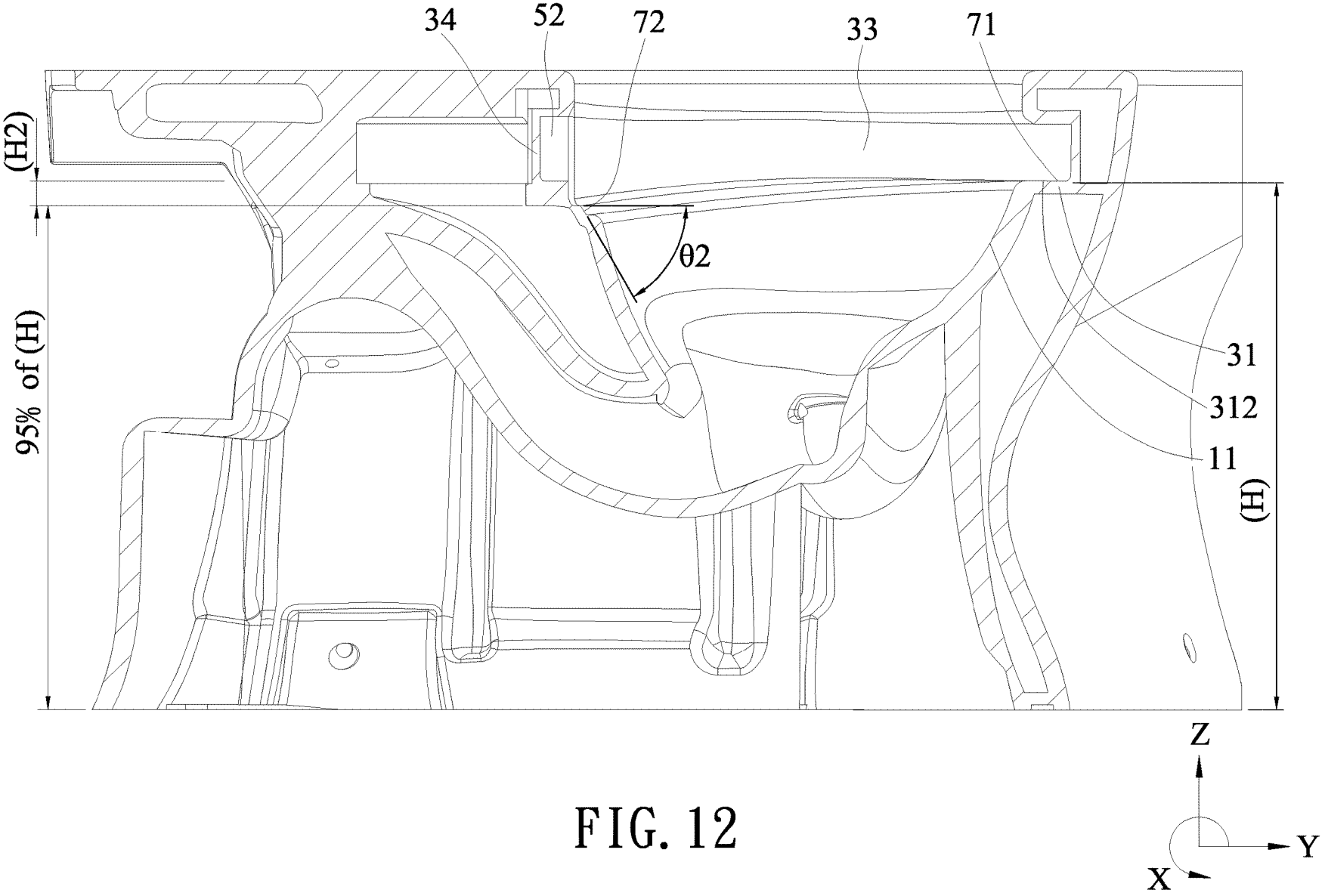
FIG. 12 is an offset sectional view taken along line XII-XII in FIG. 9.
Figure 13:
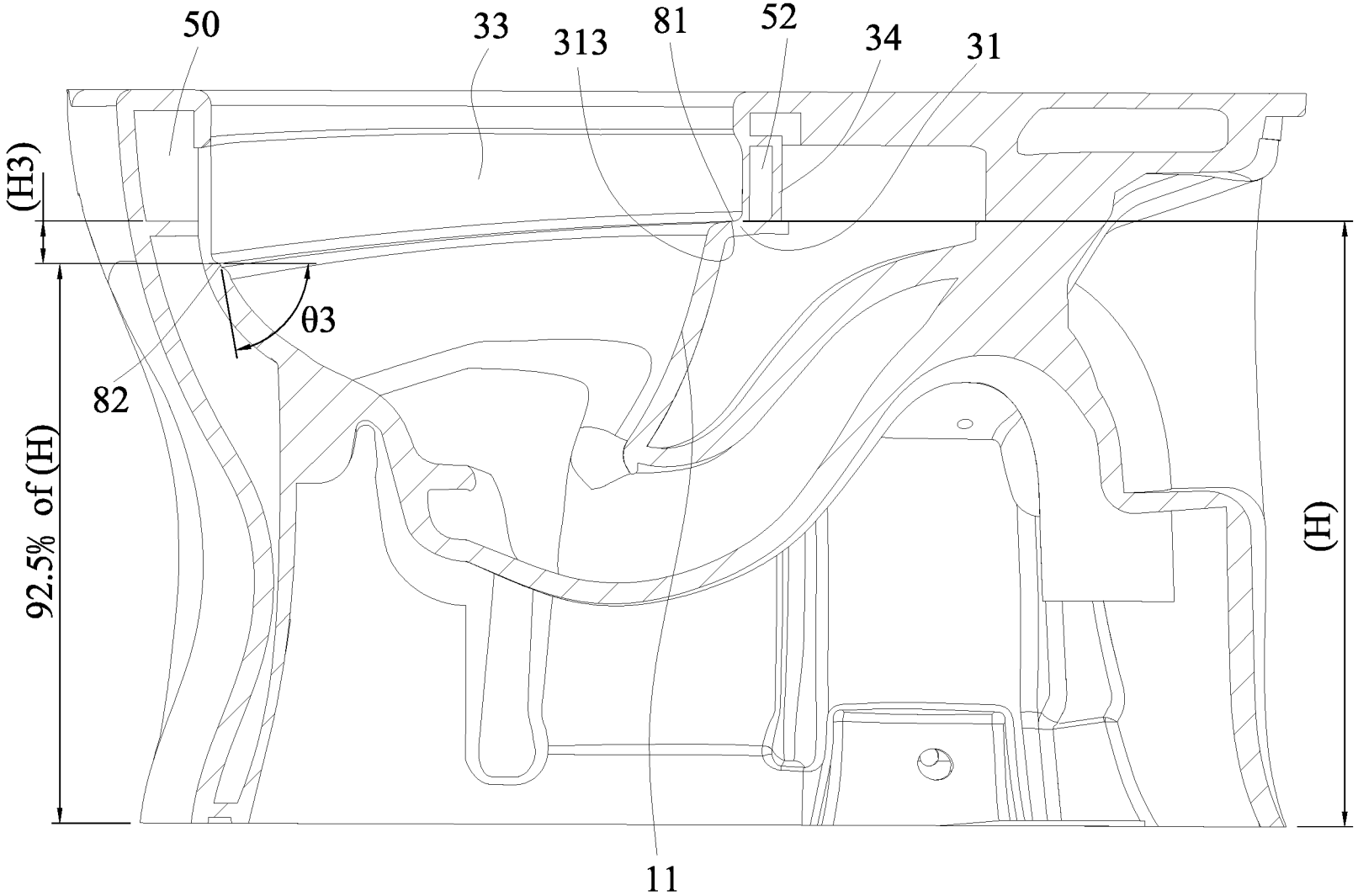
FIG. 13 is an offset sectional view taken along line XIII-XIII in FIG. 9.

Further referring to FIGS. 9 and 10, the toilet bowl 10 has a bowl surface 11 that defines a bowl space 12 and that has a front region 111, a rear region 112 disposed behind the front region 111 in a front-rear direction (X), and two lateral regions 113, 114 spaced apart from each other in a lateral direction (Y) perpendicular to the front-rear direction (X). Each of the lateral regions 113, 114 interconnects the front region 111 and the rear region 112.

The draining pipe 20 is connected to a lower portion of the toilet bowl 10 for discharging of excreta.

As shown in FIGS. 6, 7 and 9, the rim unit 30 is connected to an upper portion of the toilet bowl 10, and is formed with a first flushing port 50 that is adjacent to one of the lateral regions 113, a second flushing port 51 that is adjacent to another one of the lateral regions 114, and a third flushing port 52 that is adjacent to the rear region 112. The first flushing port 50 has a sectional area in a height direction (Z) that is perpendicular to the front-rear direction (X) and the lateral direction (Y). The sectional area of the first flushing port 50 is greater than a sectional area of the second flushing port 51 in the height direction (Z). The sectional area of the second flushing port 51 in the height direction (Z) is greater than a sectional area of the third flushing port 52 in the height direction (Z).

As shown in FIGS. 8 to 10, the rim unit 30 has a first water-guiding passage 60 that is in fluid communication with the first flushing port 50, a second water-guiding passage 70 that is in fluid communication with the second flushing port 51 and that disposed downstream of the first water-guiding passage 60, and a third water-guiding passage 80 that is in fluid communication with the third flushing port 52 and that is disposed downstream of the second water-guiding passage 70. The first water-guiding passage 60 has a first starting end 61 and a first ending end 62 disposed downstream of the first starting end 61, extends from the one of the lateral regions 113 through the front region 111 to the another one of the lateral regions 114, and has a width in a radial direction transverse to the height direction (Z) decreasing gradually from the first starting end 61 to the first ending end 62. The second water-guiding passage 70 has a second starting end 71 and a second ending end 72 disposed downstream of the second starting end 71, extends from the another one of the lateral regions 114 to the rear region 112, and has a width in the radial direction decreasing gradually from the second starting end 71 to the second ending end 72. The third water-guiding passage 80 has a third starting end 81 and a third ending end 82 disposed downstream of the third starting end 81, extends from the rear region 112 to the one of the lateral regions 113, and has a width in the radial direction decreasing gradually from the third starting end 81 to the third ending end 82.

In this embodiment, the first water-guiding passage 60 is adapted to guide water flowing into the bowl space 12 to cover at least 70% of an area of the bowl surface 11. The second water-guiding passage 70 is adapted to guide water flowing into the bowl space 12 to cover at least 20% of the area of the bowl surface 11. The third water-guiding passage 80 is adapted to guide water flowing into the bowl space 12 to cover at least 40% of the area of the bowl surface 11.

The rim unit 30 includes a bottom wall 31 connected to the bowl surface 11, a surrounding wall 32 connected to a periphery of the bottom wall 31 and extending from the one of the lateral regions 113 through the front region 111 to the another one of the lateral regions 114, a first partitioning wall 33 disposed on the bottom wall 31 and extending from the another one of the lateral regions 114 to the rear region 112, and a second partitioning wall 34 disposed on the bottom wall 31 and extending from the rear region 112 to the one of the lateral regions 113. The bottom wall 31 cooperates with the bottom wall 31 to define the first water-guiding passage 60. The first partitioning wall 33 cooperates with the bottom wall 31 to define the second water-guiding passage 70. The second partitioning wall 34 cooperates with the bottom wall 31 to define the third water-guiding passage 80.

The bottom wall 31 of the rim unit 30 has a first water-guiding surface 311 that defines a bottom surface of the first water-guiding passage 60, a second water-guiding surface 312 that defines a bottom surface of the second water-guiding passage 70, and a third water-guiding surface 313 that defines a bottom surface of the third water-guiding passage 80.

The surrounding wall 32 has an upstream portion 321 and a downstream portion 322 disposed downstream of the upstream portion 321. The first partitioning wall 33 has a first starting portion 331 that is adjacent to the downstream portion 322, that is disposed at an outer side of the downstream portion 322 in the radial direction, and that is spaced apart from the downstream portion 322 to define the second flushing port 51 and the second starting end 71 of the second water-guiding passage 70 therebetween, and a first ending portion 332 that is disposed downstream of the first starting portion 331. The second partitioning wall 34 has a second starting portion 341 that is disposed adjacent to the first ending portion 332, that is disposed at an outer side of the first ending portion 332 in the radial direction, and that is spaced apart from the first ending portion 332 to define the third flushing port 52 and the third starting end 81 of the third water-guiding passage 80 therebetween, and a second ending portion 342 that is disposed adjacent to the upstream portion 321, that is disposed at an inner side of the upstream portion 321 in the radial direction, and that is spaced apart from the upstream portion 321 to define said first flushing port 50 and the first starting end 61 of the first water guiding passage 60 therebetween.

Further referring to FIGS. 11 to 13 and FIG. 24, the first water-guiding surface 311 has a height in the height direction (Z) decreasing gradually from the first starting end 61 to the first ending end 62. A minimum distance between the first starting end 61 and the first ending end 62 in the height direction (Z) is a first height difference (H1). The second water-guiding surface 312 has a height in the height direction (Z) decreasing gradually from the second starting end 71 to the second ending end 72. A minimum distance between the second starting end 71 and the second ending end 72 in the height direction (Z) is a second height difference (H2) that is greater than the first height difference (H1). The third water-guiding surface 313 has a height in the height direction (Z) decreasing gradually from the third starting end 81 to the third ending end 82. A minimum distance between the third starting end 81 and the third ending end 82 in the height direction (Z) is a third height difference (H3) that is greater than the second height difference (H2). In this embodiment, for example, the height of the first water-guiding surface 311 at the first starting end 61 in the height direction (Z) is given as (H), the height of the first water-guiding surface 311 at the first ending end 62 is equal to 97.5% of (H), and the first height difference (H1) is equal to 2.5% of (H). Similarly, the height of the second water-guiding surface 312 at the second starting end 71 in the height direction (Z) is given as (H), the height of the second water-guiding surface 312 at the second ending end 72 is equal to 95% of (H), and the second height difference (H2) is equal to 5% of (H). Finally, the height of the third water-guiding surface 313 at the third starting end 81 in the height direction (Z) is given as (H), the height of the third water-guiding surface 313 at the third ending end 82 is equal to 92.5% of (H), and the third height difference (H3) is equal to 7.5% of (H).

Figure 25:
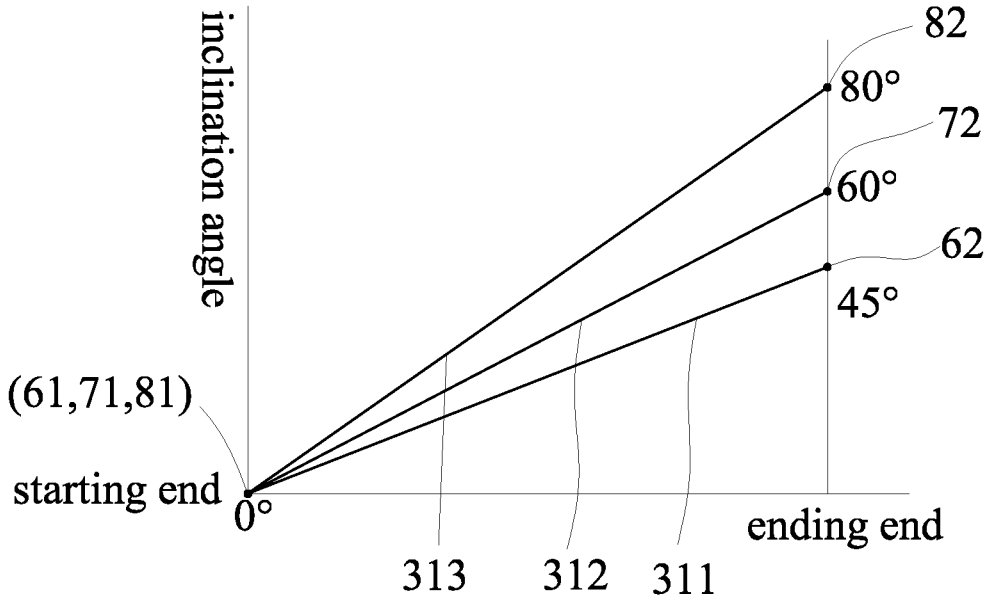
FIG. 25 is a diagram illustrating an inclination angle of the first, second, and third water-guiding passages.

Further referring to FIG. 25, the first inclination angle defined between the first water-guiding surface 311 and a horizontal line that is transverse to the height direction (Z) increases gradually from the first starting end 61 to the first ending end 62. A first angle difference (θ1) is defined between the first starting end 61 and the first ending end 62. A second inclination angle defined between the second water-guiding surface 312 and the horizontal line increases gradually from the second starting end 71 to the second ending end 72. A second angle difference (θ2) is defined between the second starting end 71 and the second ending end 72 and is greater than the first angle difference (θ1). A third inclination angle defined between the third water-guiding surface 313 and the horizontal line increases gradually from the third starting end 81 to the third ending end 82.

A third angle difference (θ3) is defined between the third starting end 81 and the third ending end 82, and is greater than the second angle difference (θ2). In this embodiment, for example, the first water-guiding surface 311 is horizontal at the first starting end 61, i.e., the first inclination angle is 0 degree at the first starting end 61, the first ending end 62 of the first water-guiding surface 311 is inclined relative to the horizontal line at 45 degrees, i.e., the first inclination angle is 45 degrees at the first ending end 62, and thus the first angle difference (θ1) is equal to 45 degrees. Similarly, the second water-guiding surface 312 is horizontal at the second starting end 71, the second ending end 72 of the second water-guiding surface 312 is inclined relative to the horizontal at 60 degrees, and thus the second angle difference (θ2) is equal to 60 degrees. The third water-guiding surface 313 is horizontal at the third starting end 81, the third ending end 82 of the third water-guiding surface 313 is inclined relative to the horizontal line at 80 degrees, and thus the third angle difference (θ3) is equal to 80 degrees.

As shown in FIGS. 6, 8, and 9, the water supply 40 defines a water chamber 41 and has a water inlet 42 in fluid communication with the water chamber 41. The water chamber 41 is in fluid communication with the first flushing port 50, the second flushing port 51, and the third flushing port 52.

In this embodiment, the sectional area of the first flushing port 50 in the height direction (Z) is greater than the sectional area of each of the second flushing port 51 and the third flushing port 52 in the height direction (Z). The first flushing port 50 is adapted for 60% of water in the water chamber 41 to pass through, e.g., per flush, the second flushing port 51 is adapted for 40% of the water in the water chamber 41 to pass through, and the third flushing port 52 is adapted for 10% of the water in the water chamber 41 to pass through.

Referring back to FIGS. 3 to 5, the water tank unit 200 is mounted on the water supply 40 and includes a tank body 210 defining a water storage space 213 therein, and a cover member 200 detachably mounted to a top of the tank body 210.

In this embodiment, the tank body 210 has an inner tank body 211 defining the water storage space 213, and an outer tank body 212 spaced apart from and surrounding the inner tank body 211 to define therebetween a clearance for passage of an electric wire (not shown).

The cover member 220 is disposed on the top of the outer tank body 212, and includes a base segment 221 and an upright segment 222 extending upwardly from the base segment 221. The base segment 221 is configured to cover the water storage space 213, and is formed with a wire hole 223 that is in spatial communication with the clearance formed between the inner tank body 211 and the outer tank body 212. The upright segment 222 defines therein an installation space 224 that is in spatial communication with the wire hole 223.

The first water discharge unit 300 is disposed in the tank body 210 and defines a first discharging hole 320 disposed downstream of the water storage space 213. In this embodiment, the first water discharge unit 300 is mounted to a bottom wall of the inner tank body 211 and extends through the inner tank body 211 to permit the first discharging hole 320 to be disposed downstream of the water storage space 213.

The second water discharge unit 310 is mounted to the tank body 210 and defines a second discharging hole 330 disposed downstream of the water storage space 213. In this embodiment, the second water discharge unit 310 is mounted to the bottom wall of the inner tank body 211 and extends through the inner tank body 211 to permit the second discharging hole 330 to be disposed downstream of the water storage space 213.

As shown in FIGS. 4 to 6, the pipe unit 400 includes a flow-out pipe 410 in fluid communication with the water inlet 42 of the water supply 40 and disposed upstream of the bowl space 12, a first flow-in pipe 420 connected to the first water discharge unit 300 and disposed downstream of the first discharging hole 320, and a second flow-in pipe 430 connected to the second water discharge unit 310, disposed downstream of the second discharging hole 330 and in fluid communication with the flow-out pipe 410.

In this embodiment, the flow-out pipe 410 extends upwardly from the water inlet 42 into the outer tank body 212, and the first flow-in pipe 420 and the second flow-in pipe 430 are disposed in the outer tank body 212 and disposed between the inner tank body 211 and the water supply 40.

The electric switching valve 500 is connected in series between the flow-out pipe 410 and the first flow-in pipe 420. In this embodiment, the electric switching valve 500 is disposed in the outer tank body 212.

Figure 14:
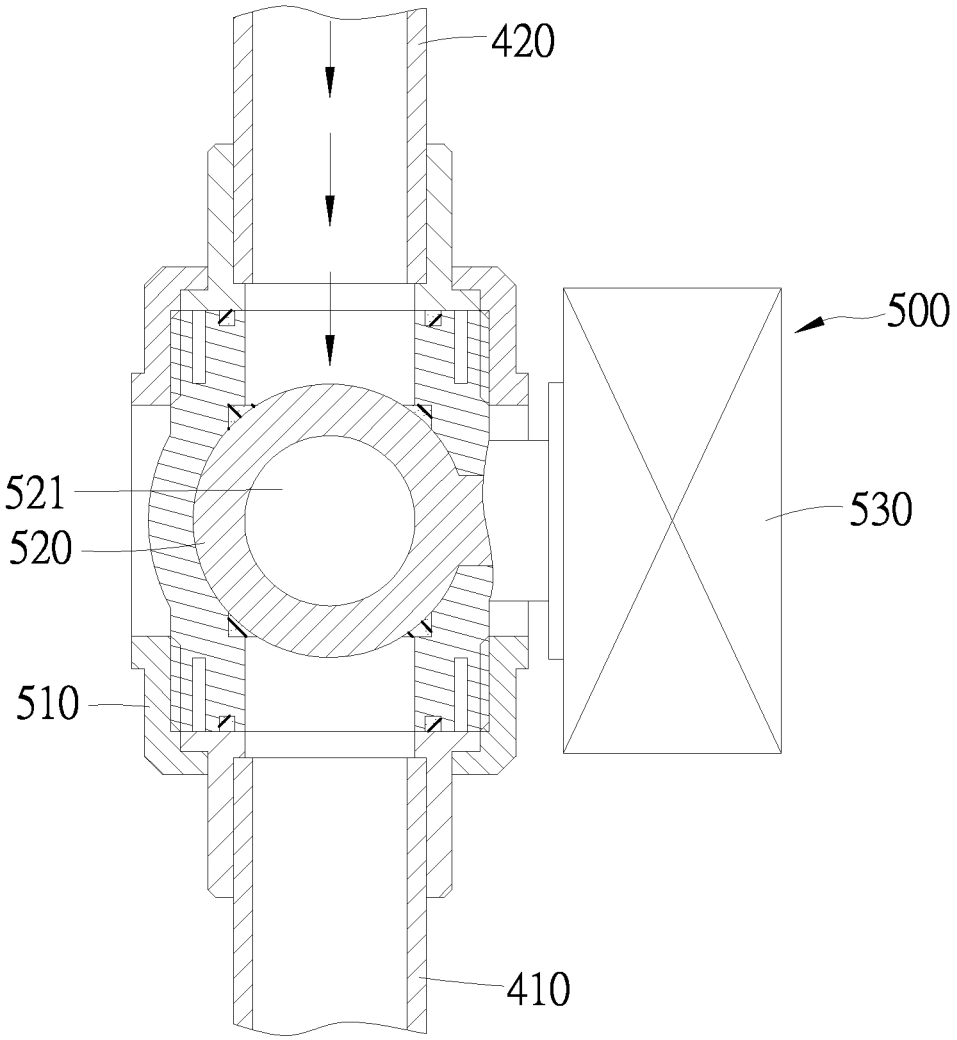
FIG. 14 is a fragmentary, partially cross-sectional view of the embodiment, illustrating a pipe unit and an electric switching valve in a blocked state.
Figure 15:
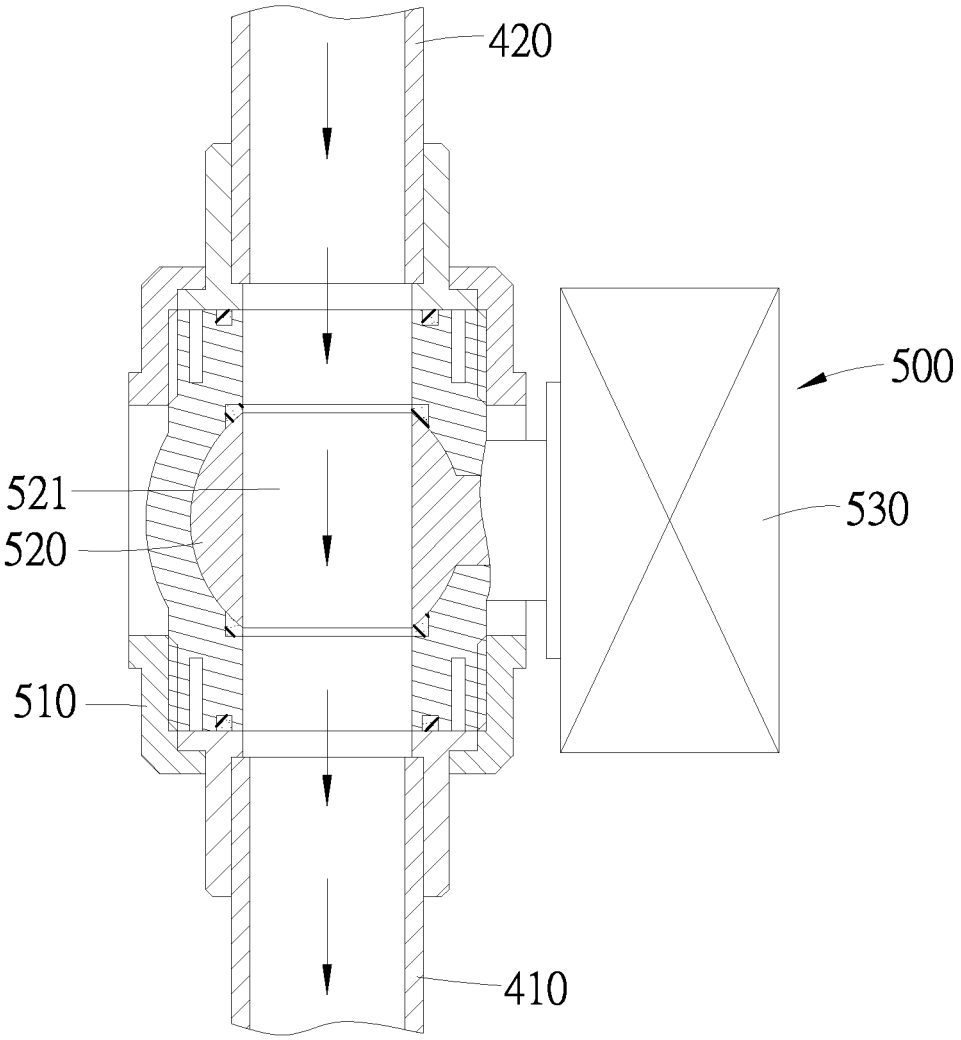
FIG. 15 is similar to FIG. 14 but illustrating the electric switching valve in a communicated state.

Referring to FIGS. 14 and 15, the electric switching valve 500 is switchable between a blocked state (see FIG. 14), where fluid communication between the flow-out pipe 410 and the first flow-in pipe 420 is blocked, and a communicated state (see FIG. 15), where the flow-out pipe 410 and the first flow-in pipe 420 are fluidly communicated with each other. In this embodiment, the electric switching valve 500 is an electric ball valve that includes a valve body 510, a valve gate 520, and a drive motor 530. The valve gate 520, which is in the form of a ball, is rollably disposed inside the valve body 510, and has a communication hole 521. The drive motor 530 is disposed on the valve body 510 for driving the rolling of the valve gate 520.

Figure 17:
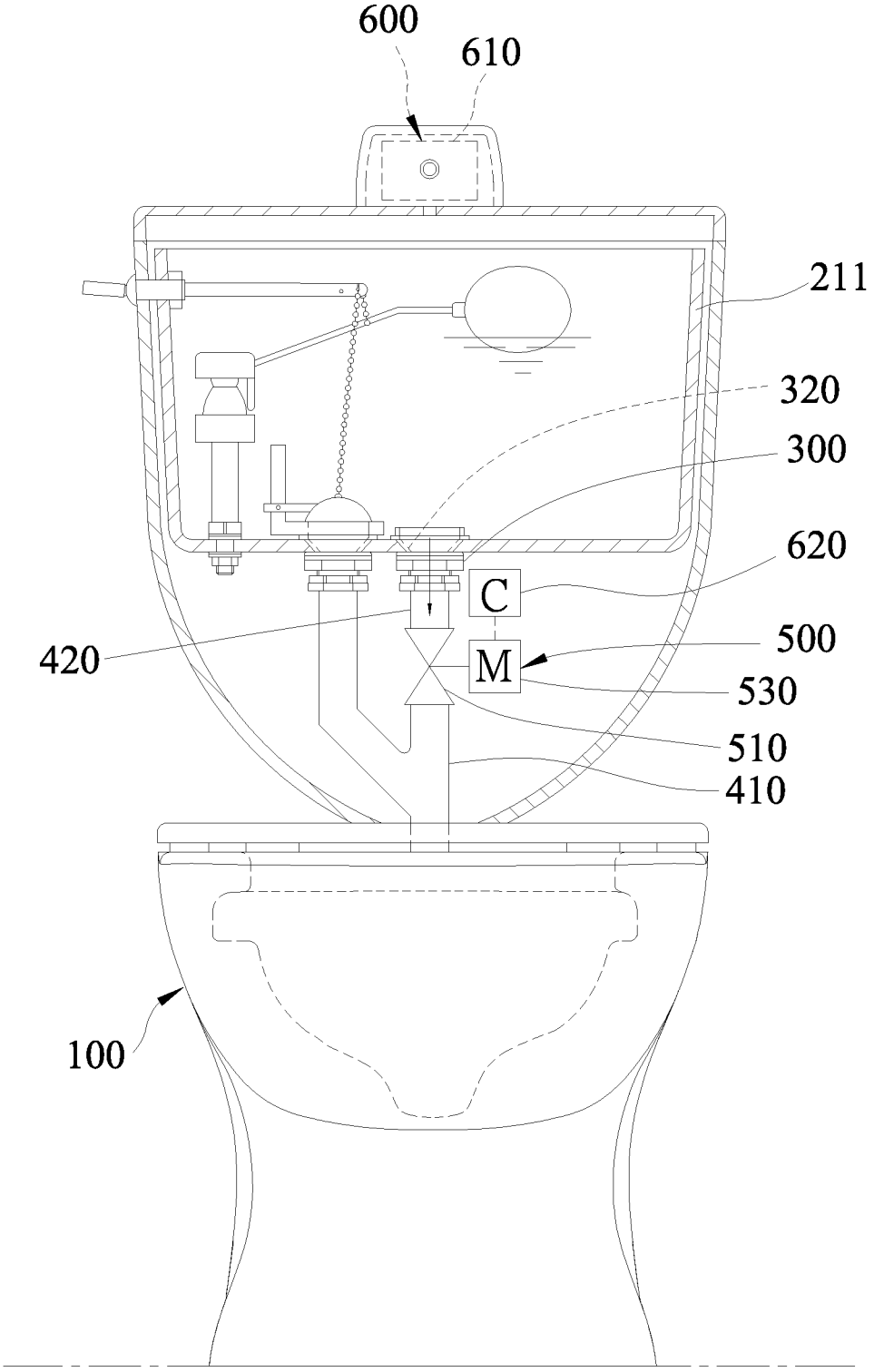
FIG. 17 is similar to FIG. 5, illustrating the electric switching valve in the blocked state.

As shown in FIGS. 14 and 17, when the electric switching valve 500 is in the blocked state, the valve gate 520 blocks fluid communication between the flow-out pipe 410 and the first flow-in pipe 420. Water in the inner tank body 211 flowing in the first flow-in pipe 420 is thus blocked by the electric switching valve 500 and does not flow into the flow-out pipe 410.

Figure 19:
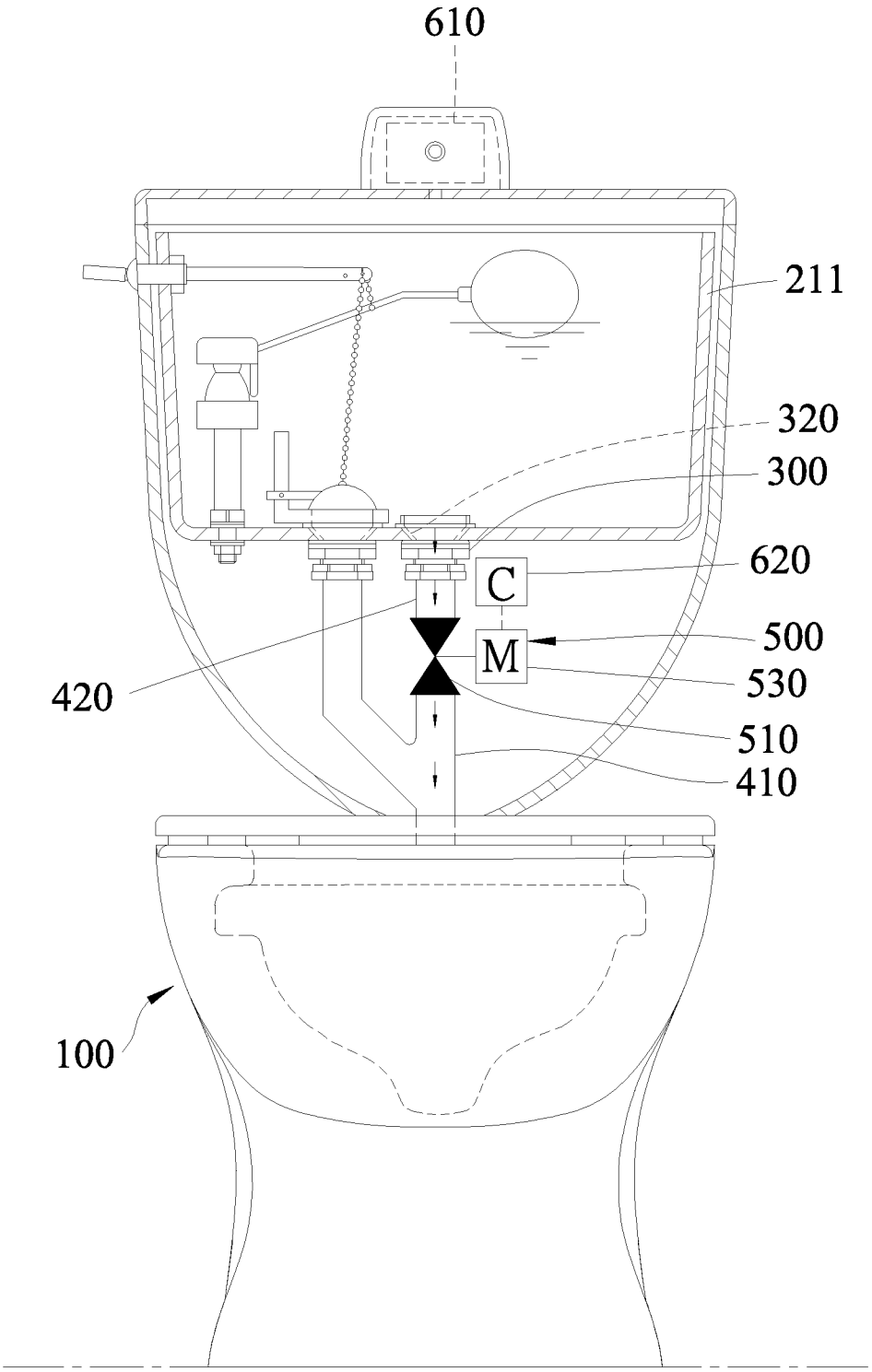
FIG. 19 is similar to FIG. 17 but illustrating the electric switching valve in the communicated state.

On the contrary, as shown in FIGS. 15 and 19, when the electric switching valve 500 is in the communicated state, the water in the inner tank body 211 flowing in the first flow-in pipe 420 flows through the electric switching valve 500 and then flows into the flow-out pipe 410.

Referring to FIGS. 4, 17 and 19, the sensor control unit 600 is disposed for controlling switching of the electric switching valve 500 between the blocked state and the communicated state.

In this embodiment, the sensor control unit 600 includes a sensor 610 disposed in the installation space 224, and a microcomputer control device 620 disposed on the electric switching valve 500 and electrically connected to the sensor 610 and the electric switching valve 500 so as to permit a sensing signal from the sensor 610 to be transmitted to the electric switching valve 500. The sensor 610 is an ultrasonic sensor or an infrared sensor, and has a sensor head 611 exposed outwardly from the upright segment 222. In one embodiment, the microcomputer control device 620 may be integrally formed with the drive motor 530 of the electric switching valve 500. It should be noted that the number of the sensor 610 may be more than one in other embodiments, and is not limited to this example.

In this embodiment, the microcomputer control device 620 is in signal communication with the sensor 610 and the electric switching valve 500 so as to permit the sensing signal from the sensor 610 to be transmitted to the electric switching valve 500. It can be appreciated that the microcomputer control device 620 may be in signal communication with the sensor 610 through an electrical wire (not shown) that is disposed in the clearance between the inner tank body 211 and the outer tank body 212. In one embodiment, the microcomputer control device 620 may be set to transmit a control signal to the drive motor 530 a predetermined time (for example, 3 seconds) after the microcomputer control device 620 has received the sensing signal from the sensor 610. Furthermore, the microcomputer control device 620 may be set to keep the electric switching valve 500 in the communicated state for a predetermined period (for example, 5 seconds to 10 seconds), thereby controlling an amount of water for flushing the toilet bowl 100. It should be noted that the microcomputer control device 620 includes a microcontroller or a controller such as, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc.

Figure 23:
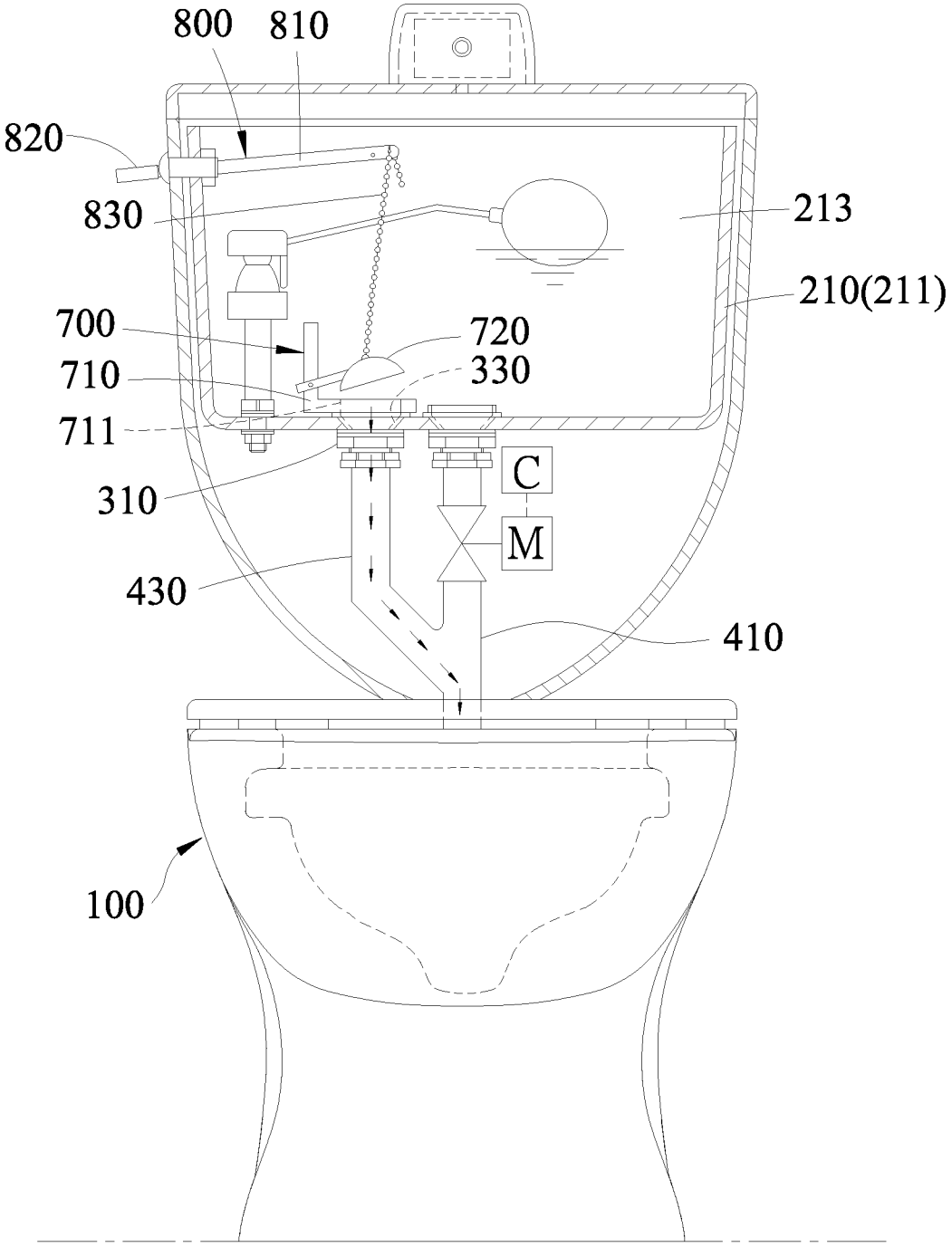
FIG. 23 is similar to FIG. 17 but illustrating the electric switching valve in the blocked state and a flush valve in an open state.
Figure 24:
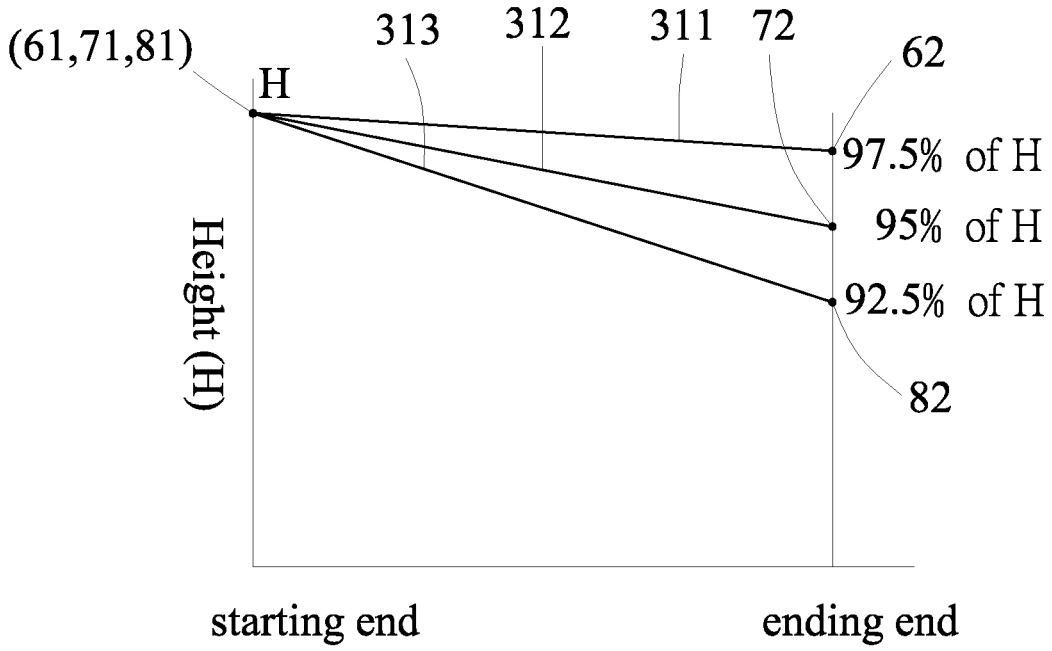
FIG. 24 is a diagram illustrating a height difference of first, second, and third water-guiding passages of the toilet stool of the embodiment.

As shown in FIGS. 5 and 23, the flush valve 700 is disposed upstream of the second flow-in pipe 430 for blocking the second discharging hole 330, and is switchable between a closed state (see FIG. 5) and an open state (see FIG. 23). When the flush valve 700 is in the closed state, the second discharging hole 330 is blocked and fluid communication between the second flow-in pipe 430 and the water storage space 213 is blocked. When the flush valve 700 is in the open state, the second flow-in pipe 430 and the water storage space 213 are fluidly communicated with each other.

In this embodiment, the flush valve 700 includes a valve seat 710 disposed in the water storage space 213 and mounted on an inner surface of the inner tank body 211 of the tank body 210 to permit the valve seat 710 to be disposed upstream of the second discharge hole 330, and a flapper 720 disposed in the water storage space 213. The valve seat 710 is connected to the second water discharge unit 310 and is formed with a water discharging hole 711 in fluid communication with the second discharge hole 330. The flapper 720 is pivotably mounted to the valve seat 710 and is movable between a closed position and an open position.

As shown in FIG. 5, the flapper 720 is configured such that when the flush valve 700 is in the closed state, the flapper 720 is disposed at the closed position to seal the water discharging hole 711 of the valve seat 710 and thus the second discharging hole 330 to block fluid communication between the second flow-in pipe 430 and the water storage space 213.

As shown in FIG. 23, the flapper 720 is configured such that when the flush valve 700 is in the open state, the flapper 720 is disposed at the open position and a seal between the flapper 720 and the valve seat 710 is broken. In this way, the second flow-in pipe 430 is in fluid communication with the water storage space 213 via the second discharging hole 330 and the water discharging hole 711.

Referring to FIGS. 3 to 5, the manual actuating unit 800 is coupled to the flush valve 700 for actuating movement of the flush valve 700 from the closed state to the open state.

Specifically, the manual actuating unit 800 includes a handle 820 mounted on an outside of the outer tank body 212 of the tank body 210, a lever 810 disposed in the water storage space 213 of the inner tank body 211 of the tank body 210 and connected to be actuated by the handle 820, and a chain 830 interconnecting the lever 810 to the flapper 720 such that when the handle 820 is manually actuated to operate the lever 810, the chain 830 is pulled by the lever 810 to thereby move the flapper 720 to the open position from the closed position and thus move the flush valve 700 to the open state from the closed state.

The water inlet valve 900 is mounted in the inner tank body 211 inside the water storage space 213, and has a bottom end extending outwardly of the inner tank body 211 of the tank body 210.

The float ball 910 is disposed inside the water storage space 213, and is pivotally movable relative to a top end of the water inlet valve 900 for controlling the water inlet valve 900.

Figure 16:
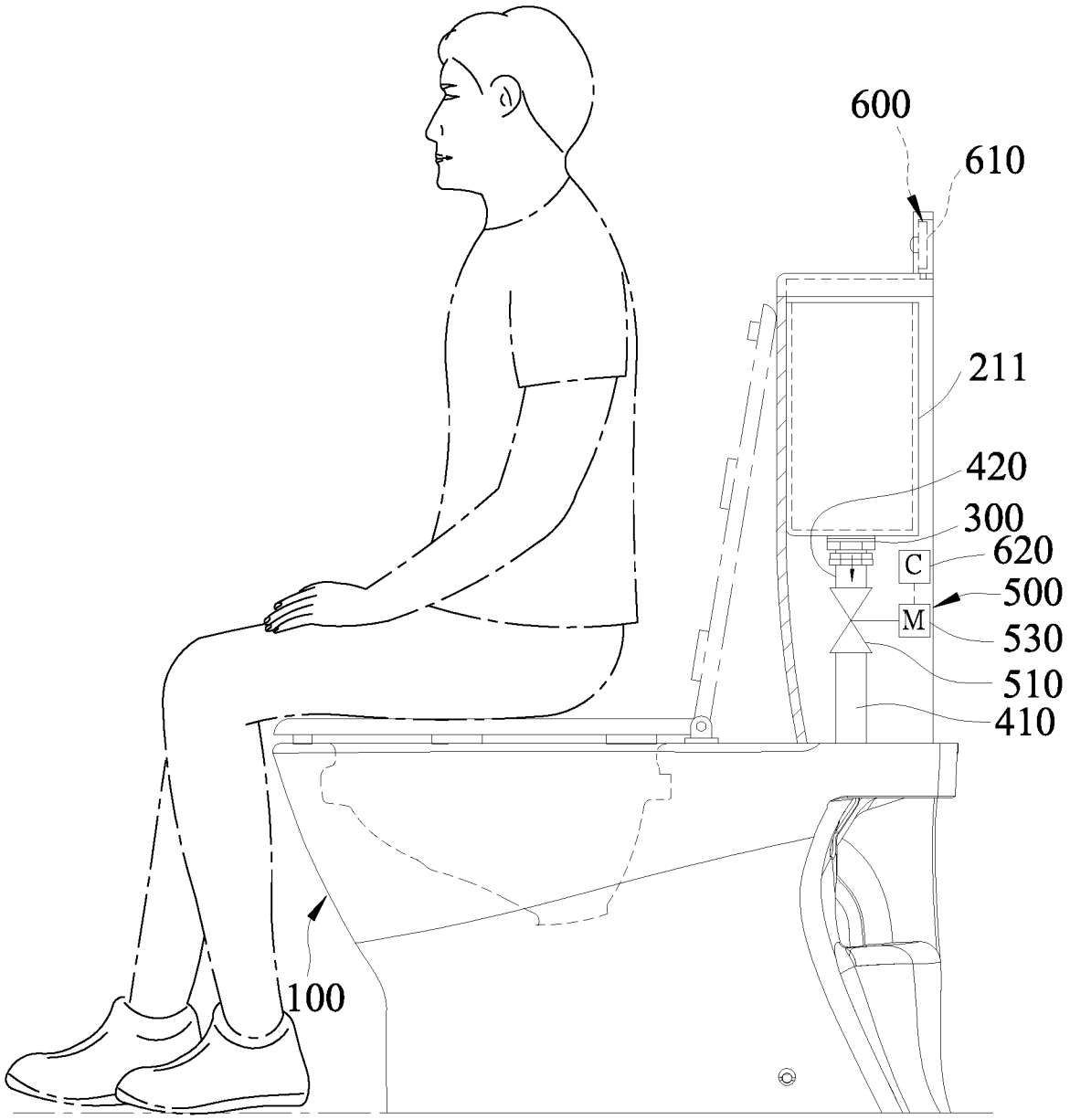
FIG. 16 is similar to FIG. 4 but illustrating a sensor control unit detecting a user seated on the toilet stool of the embodiment.

As shown in FIGS. 16 and 17, when the sensor 610 of the sensor control unit 600 detects a user seated on the toilet stool 100, the sensor 610 transmits the sensing signal to the microcomputer control device 620, and thereafter, the microcomputer control device 620 transmits the control signal to the drive motor 530. At this point, the electric switching valve 500 is kept in the blocked state. As such, the water in the water storage space 213 does not flow into the flow-out pipe 410 through the first discharge port 330 of the first water discharge member 300, the first flow-in pipe 420, the electric switching valve 500, and the first connection pipe 33.

Figure 18:
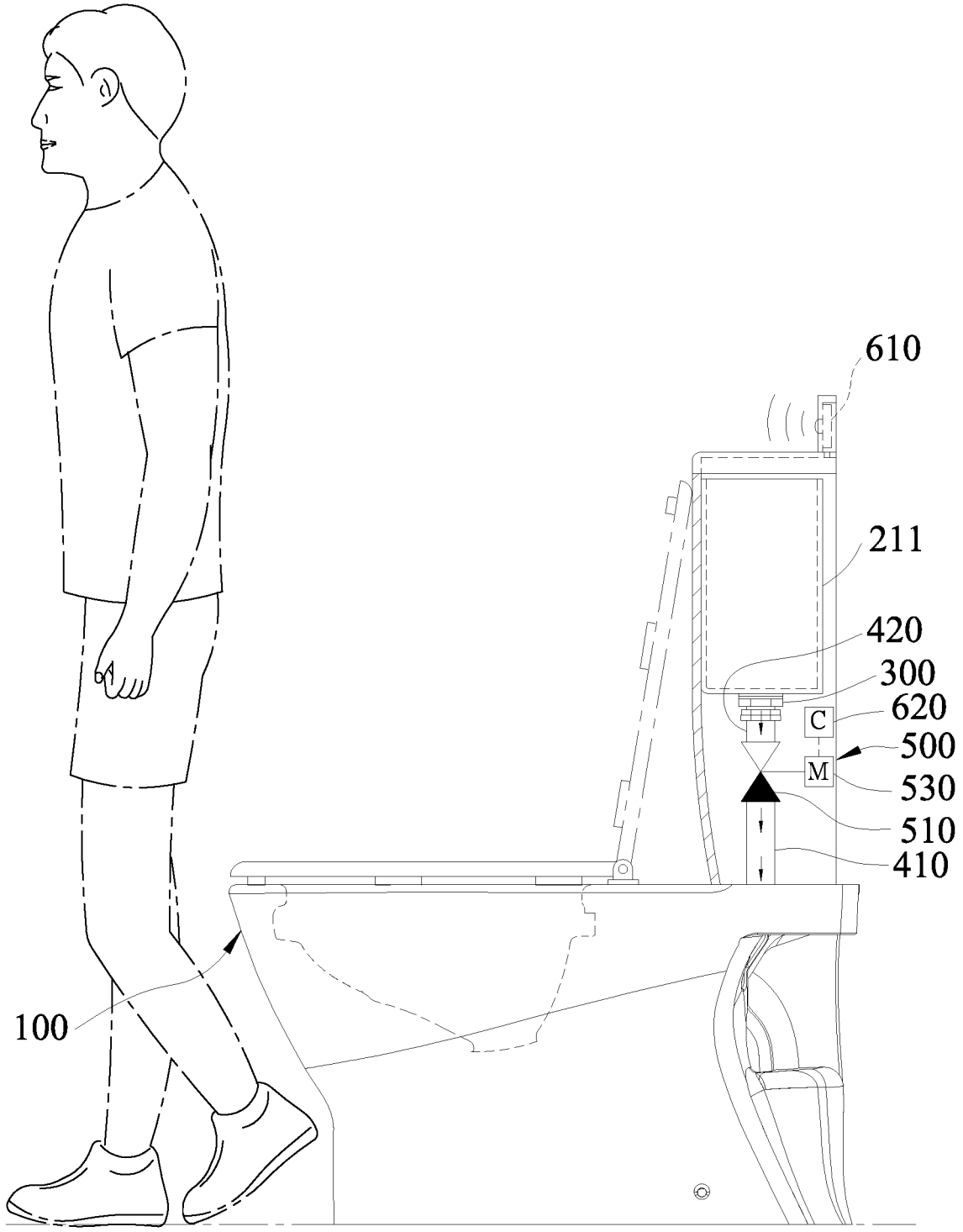
FIG. 18 is similar to FIG. 16 but illustrating the sensor control unit detecting the user leaving the toilet stool.

As shown in FIGS. 18 and 19, after the sensor 610 of the sensor control unit 600 detects the user leaving the toilet stool 100, the sensor 610 transmits another sensing signal to the microcomputer control device 620. The microcomputer control device 620 may be set to transmit another control signal to the drive motor 530 a predetermined time (for example, 3 seconds) after the microcomputer control device 620 received the sensing signal from the sensor 610, so as to switch the electric switching valve 500 to the communicated state. As such, the water from the water storage space 213 may flow into the flow-out pipe 410 through the first discharge port 320 of the first water discharge member 300, the first flow-in pipe 420, and the electric switching valve 500 for flushing away the excreta inside the toilet bowl 100. A flushing period (for example, 5 seconds to 100 seconds) is determined by the predetermined period during which the electric switching valve 500 is kept in the communicated state, and may be controlled by the microcomputer control device 620 to thereby control the amount of water for the flushing. After the flushing period, the microcomputer control device 620 emits the control signal to switch the electric switching valve 500 back to the blocked state (FIG. 17) so as to stop the flushing.

Figure 20:
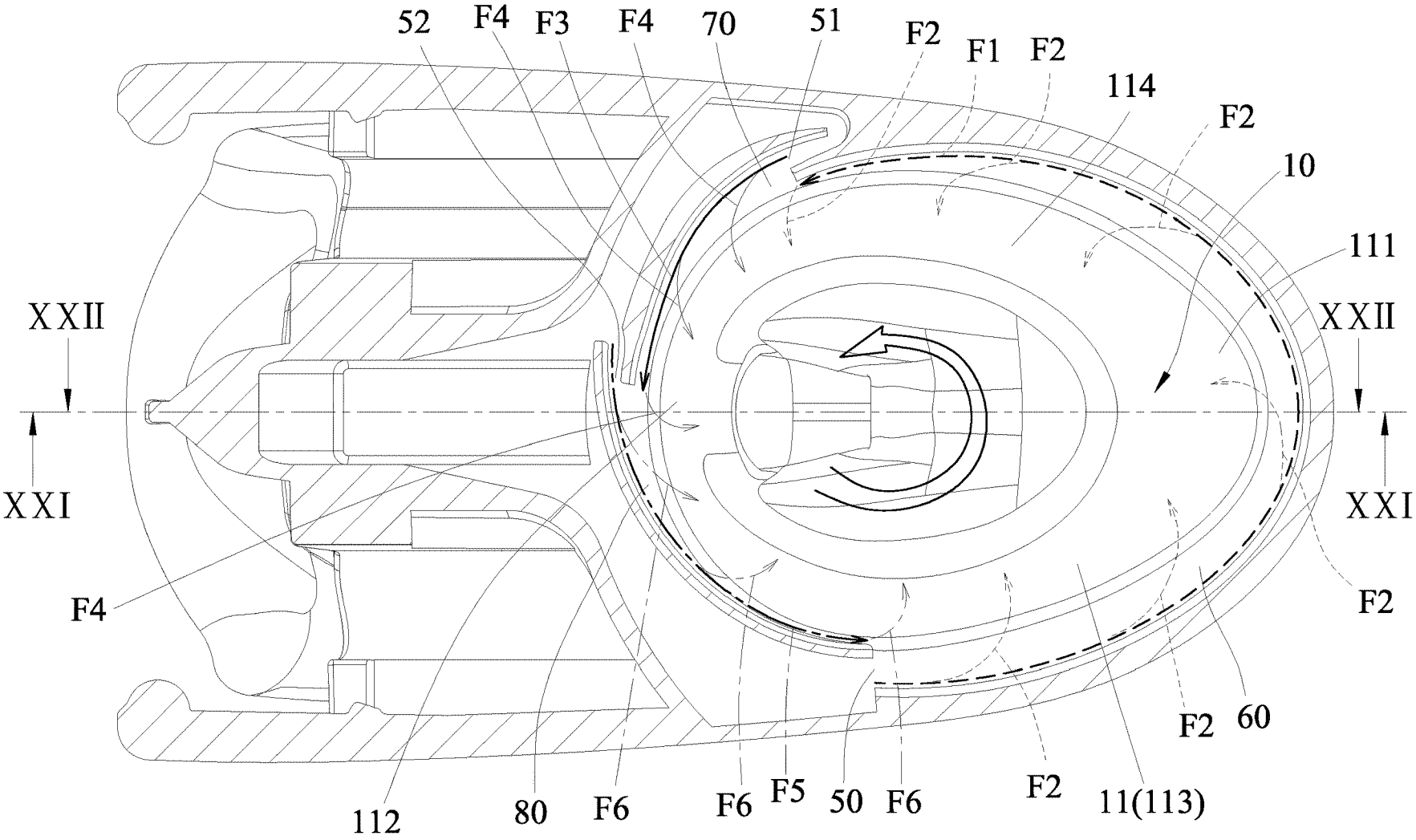
FIG. 20 is similar to FIG. 9 but illustrating vortex flows of water flowing in the embodiment
Figure 21:
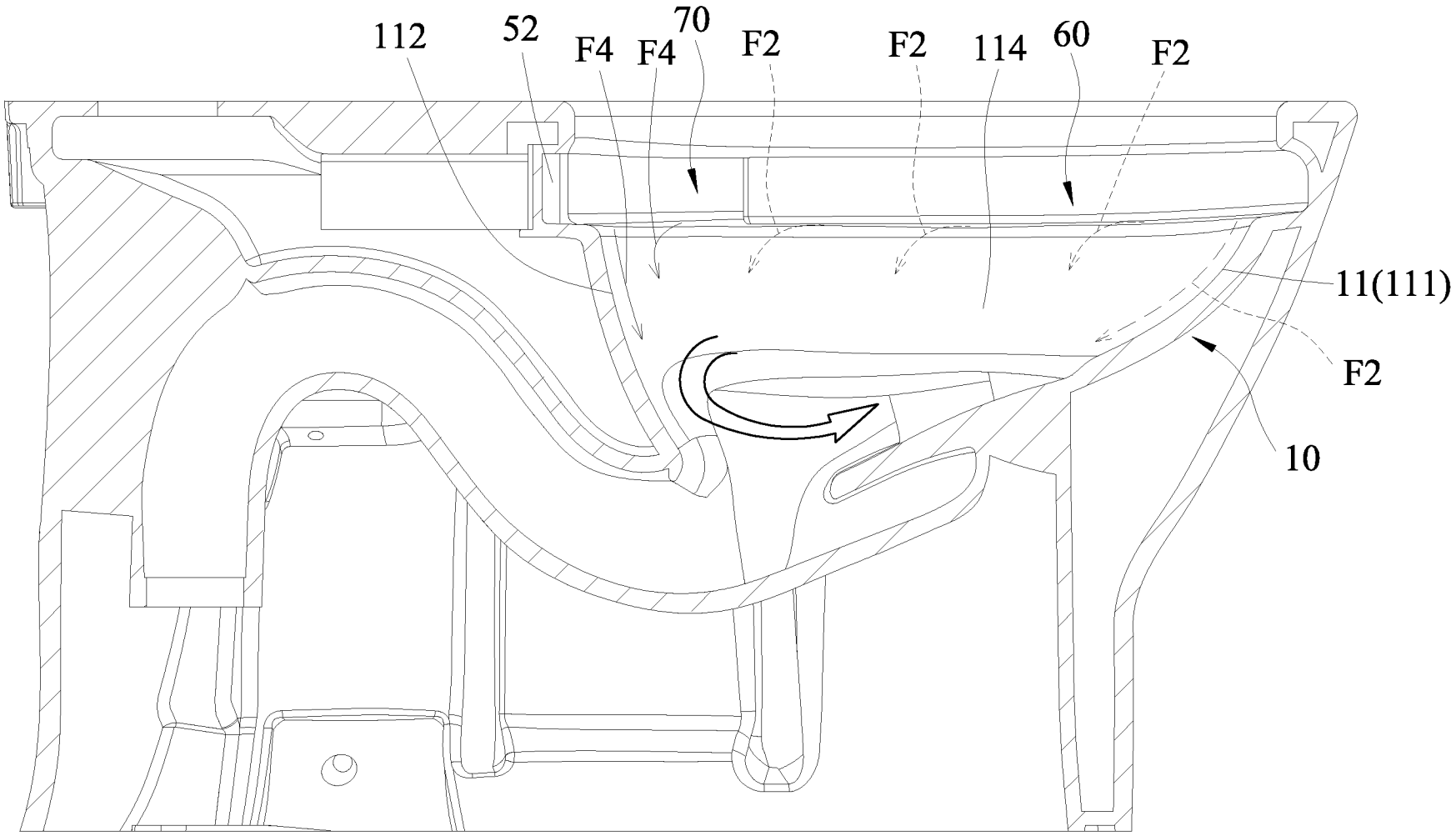
FIG. 21 is a sectional view taken along line XXI-XXI in FIG. 20, illustrating vortex flows of water flowing in the embodiment.
Figure 22:
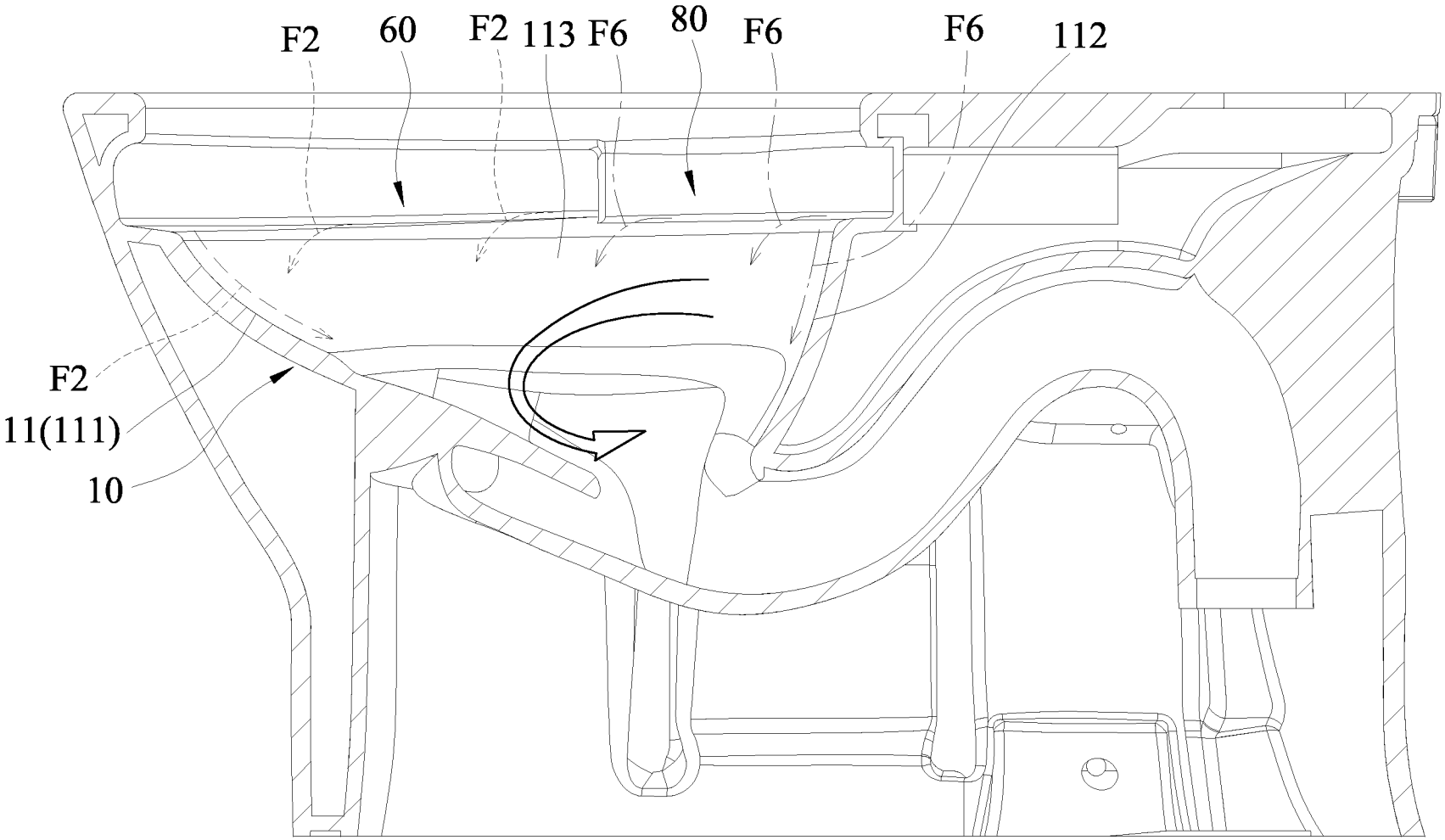
FIG. 22 is a sectional view taken along line XXII-XXII in FIG. 20, illustrating vortex flows of water flowing in the embodiment.

Referring to FIGS. 20 to 22, during flushing of the vortex flush toilet, water discharged from the first water flushing port 50 flows forwardly along the first water-guiding passage 60, passes by the one of the lateral regions 113 and the front region 111 to the another one of the lateral regions 114 to thereby form a vortex flow (F1). At this time, a portion of the water discharged from the first water flushing port 50 falls on a middle portion of the toilet bowl 10 and forms a plurality of flushing vortex flows (F2) to flush the front region 111 and the lateral regions 113, 114. Water discharged from the second water flushing port 51 flows rearwardly along the second water-guiding passage 70, passes by the other one of the lateral regions 114 to the rear region 112 to thereby form another vortex flow (F3). At this time, a portion of the water discharged from the second water flushing port 51 falls on the middle portion of the toilet bowl 10 and forms another plurality of flushing vortex flows (F4) to flush the another one of the lateral regions 114 and the rear region 112. Water discharged from the third water flushing port 52 flows forwardly along the third water-guiding passage 80, passes by the rear region 112 and the one of the lateral regions 113 to thereby form yet another vortex flow (F5). At this time, a portion of the water discharged from the third water flushing port 52 falls on the middle portion of the toilet bowl 10 and forms yet another plurality of flushing vortex flows (F6) to flush the rear region 112 and the one of the lateral regions 113.

In addition, in a case where the electric switching valve 500 is unable to be driven, e.g., under a blackout condition, a user may manually press down the handle 820 of the manual actuating unit 28 to operate the lever 810 and the chain 830, to thereby move the flapper 720 to the open position, i.e., to switch the flush valve 700 to the open state (see FIG. 23). In this case, water in the water storage space 213 flows into the flow-out pipe 410 through the second discharging hole 330 and the second flow-in pipe 430, thereby flushing the excreta inside the toilet bowl 10. After the user releases the handle 820, the flush valve 700 returns to the closed state (FIG. 17) to stop the flushing.

Through the above description, the advantages of the present disclosure are summarized as follows:

First, as compared to the conventional flush toilets described in the background section, by virtue of the design of the height difference (i.e., the first height difference (H1) defined by the height of the first water-guiding surface 311 that decreases gradually from the first starting end 61 to the first ending end 62, the second height difference (H2) defined by the height of the second water-guiding surface 312 that decreases gradually from the second starting end 71 to the second ending end 72, and the third height difference (H3) defined by the height of the third water-guiding surface 313 that decreases gradually from the third starting end 81 to the third ending end 82), in cooperation with the design of the angle difference (i.e., the first angle difference (θ1) defined between the first starting end 61 and the first ending end 62 of the first water-guiding passage 60, the second angle difference (θ2) defined between the second starting end 71 and the second ending end 72 of the second water-guiding passage 70, and the third angle difference (θ3) defined between the third starting end 81 and the third ending end 82 of the third water-guiding passage 80), flushing forces of water located downstream of the first water-guiding passage 60, the second water-guiding passage 70, and the third water-guiding passage 80 may be effectively increased to enhance flushing effect at the rear region 112 of the bowl surface 11.

Second, the design of the first water-guiding passage 60, the second water-guiding passage 70, and the third water-guiding passage 80 that are arranged sequentially from the upstream portion 321 to the downstream portion 322 may facilitate an increase of the vortex flows formed in the toilet bowl 10. Specifically, the vortex flow (F3) in the second water-guiding passage 70 strengthens the vortex flow (F1) downstream of the first water-guiding passage 60, and the vortex flow (F5) in the third water-guiding passage 80 strengthens the vortex flow (F3) downstream of the second water-guiding passage 70. In this way, strength of each of the vortex flows (F1, F3, F5) and the flushing vortex flows (F2, F4, F6) is increased to enhance flushing effect on the bowl surface 11 of the toilet bowl 10.

Third, since the first water-guiding passage 60 flushes the front region 111 and the lateral regions 113, 114, the second water-guiding passage 70 flushes the rear region 112 and a rear portion of the lateral region 114, the third water-guiding passage 80 flushes the rear region 112 and a rear portion of the lateral region 113, the entire bowl surface 11 may be comprehensively and thoroughly flushed without leaving excreta in the toilet bowl 10.

Fourth, by virtue of the design of the third height difference (H3) being greater than the second height difference (H2), the second height difference (H2) being greater than the first height difference (H1), the third angle difference (θ3) being greater than the second angle difference (θ2), and the second angle difference (θ2) being greater than the first angle difference (θ1), a potential energy of water at the downstream of each of the first water-guiding passage 60, the second water-guiding passage 70, and the third water-guiding passage 80 is increased because of the height difference. In this way, the flushing force of water is increased to urge the excreta in the toilet bowl 10 to sink downwardly and then to be discharged from the draining pipe 20 to a septic tank or a sewage piping system (not shown).

Fifth, by virtue of the design of the width of each of the first water-guiding passage 60, the second water-guiding passage 70, and the third water-guiding passage 80 that decreases gradually from a respective one of the first, second, and third starting ends 61, 71, 81 to a corresponding one of the first, second, and third ending ends 62, 72, 82, a flow rate of water at the downstream of each of the first water-guiding passage 60, the second water-guiding passage 70, and the third water-guiding passage 80 is increased.

Sixth, with the provision of the pipe unit 400 in cooperation with the electric switching valve 500, and the sensor control unit 60 for automatically controlling the switch of the electric switching valve 500 between the blocked state and the communicated state, automatic flushing of the vortex flush toilet of the embodiment may be achieved. Therefore, the vortex flush toilet may be useful for maintaining a hygienic environment for the next user.

Seventh, under a blackout condition or malfunction of the electric switching valve 500, the manual actuating unit 800 may be manually operated to switch the flush valve 700 to the open state for flushing. Thus, the vortex flush toilet of the embodiment is still operable under the blackout condition.

Eighth, since the communication hole 521 of the valve gate 520 of the electric switching valve 50 has a dimension the same as an inner diameter of each of the flow-out pipe 410 and the first flow-in pipe 420, when the electric switching valve 500 is switched to the communicated state, a sufficient amount of water from the flow-out pipe 410 is provided for flushing the toilet bowl 10.

Ninth, the microcomputer control device 620 of the sensor control unit 600 may be set to control the predetermined period during which the electric switching valve 500 is kept in the communicated state, thereby controlling the flushing time period and the amount of the water for flushing the toilet stool 100. Therefore, the microcomputer control device 620 may be useful for water-saving.

In summary, the vortex flush toilet of the present disclosure not only effectively increases the flushing force of water at the downstream of each of the first water-guiding passage 60, the second water-guiding passage 70, and the third water-guiding passage 80 to urge the excreta in the toilet bowl 10 to sink downwardly, but the vortex flows (F1, F3, F5) and the flushing vortex flows (F2, F4, F6) are also generated to enhance the flushing effect at the rear region 112 of the bowl surface 11. In addition, the vortex flush toilet may flush automatically, and is still operable under a blackout condition.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A vortex flush toilet comprising:

a toilet stool that includes a toilet bowl having a bowl surface that defines a bowl space and that has a front region, a rear region disposed behind said front region, and two lateral regions each interconnecting said front region and said rear region, a draining pipe connected to a lower portion of said toilet bowl, a rim unit connected to an upper portion of said toilet bow, and being formed with a first flushing port that is adjacent to one of said lateral regions, a second flushing port that is adjacent to another one of said lateral regions, and a third flushing port that is adjacent to said rear region, said first flushing port having a sectional area in a height direction greater than a sectional area of said second flushing port in the height direction, the sectional area of said second flushing port in the height direction being greater than a sectional area of said third flushing port in the height direction, said rim unit having a first water-guiding passage that is in fluid communication with said first flushing port, that has a first starting end and a first ending end disposed downstream of said first starting end, that extends from the one of said lateral regions through said front region to the another one of said lateral regions, that has a width in a radial direction transverse to the height direction decreasing gradually from said first starting end to said first ending end, and that is adapted to guide water flowing into said bowl space to cover at least 70% of an area of said bowl surface, a second water-guiding passage that is in fluid communication with said second flushing port, that is disposed downstream of said first water-guiding passage, that has a second starting end and a second ending end disposed downstream of said second starting end, that extends from the another one of said lateral regions to said rear region, that has a width in the radial direction decreasing gradually from said second starting end to said second ending end, and that is adapted to guide water flowing into said bowl space to cover at least 20% of the area of said bowl surface, and a third water-guiding passage that is in fluid communication with said third flushing port, that is disposed downstream of said second water-guiding passage, that has a third starting end and a third ending end disposed downstream of said third starting end, that extends from said rear region to the one of said lateral regions, that has a width in the radial direction decreasing gradually from said third starting end to said third ending end, and that is adapted to guide water flowing into said bowl space to cover at least 40% of the area of said bowl surface, a first water-guiding surface that defines a bottom surface of said first water-guiding passage, and that has a height in the height direction decreasing gradually from said first starting end to said first ending end, a minimum distance between said first starting end and said first ending end in the height direction being a first height difference, a first inclination angle defined between said first water-guiding surface and a horizontal line that is transverse to the height direction increasing gradually from said first starting end to said first ending end, a first angle difference being defined between said first starting end and said first ending end, a second water-guiding surface that defines a bottom surface of said second water-guiding passage, and that has a height in the height direction decreasing gradually from said second starting end to said second ending end, a minimum distance between said second starting end and said second ending end in the height direction being a second height difference that is greater than the first height difference, a second inclination angle defined between said second water-guiding surface and a horizontal line that is transverse to the height direction increasing gradually from said second starting end to said second ending end, a second angle difference being defined between said second starting end and said second ending end and being greater than the first angle difference, and a third water-guiding surface that defines a bottom surface of said third water-guiding passage, and that has a height in the height direction decreasing gradually from said third starting end to said third ending end, a minimum distance between said third starting end and said third ending end in the height direction being a third height difference that is greater than the second height difference, a third inclination angle defined between said third water-guiding surface and the horizontal line increasing gradually from said third starting end to said third ending end, a third angle difference being defined between said third starting end and said third ending end, and being greater than the second angle difference; and a water supply defining a water chamber that is in fluid communication with said first flushing port, said second flushing port and said third flushing port, and having a water inlet that is in fluid communication with said water chamber, a water tank unit that includes a tank body defining a water storage space therein;

a first water discharge unit that is disposed in said tank body and that defines a first discharging hole disposed downstream of said water storage space;

a pipe unit that includes a flow-out pipe in fluid communication with said water inlet of said water supply and disposed upstream of said bowl space, and a first flow-in pipe connected to said first water discharge unit and disposed downstream of said first discharging hole, an electric switching valve that is connected in series between said flow-out pipe and said first flow-in pipe, and that is switchable between a blocked state, where fluid communication between said flow-out pipe and said first flow-in pipe is blocked, and a communicated state, where said flow-out pipe and said first flow-in pipe are fluidly communicated with each other; and a sensor control unit disposed for controlling switching of said electric switching valve between the blocked state and the communicated state.

2. The vortex flush toilet as claimed in claim 1, wherein:

said first flushing port is adapted for 60% of water in said water chamber to pass through;

said second flushing port is adapted for 40% of the water in said water chamber to pass through; and said third flushing port is adapted for 10% of the water in said water chamber to pass through.

3. The vortex flush toilet as claimed in claim 1, wherein said rim unit includes:

a bottom wall having said first water-guiding surface, said second water-guiding surface, and said third water-guiding surface;

a surrounding wall connected to a periphery of said bottom wall and extending from the one of said lateral regions through said front region to the another one of said lateral regions, cooperating with said bottom wall to define said first water-guiding passage, and having an upstream portion and a downstream portion that is disposed downstream of said upstream portion;

a first partitioning wall disposed on said bottom wall and extending from the another one of said lateral regions to the rear region, cooperating with said bottom wall to define said second water-guiding passage, and having a first starting portion that is adjacent to said downstream portion and that is disposed at an outer side of said downstream portion in the radial direction, and a first ending portion that is disposed downstream of said first starting portion adjacent to said upstream portion; and a second partitioning wall disposed on said bottom wall, extending from the rear region to one of said lateral regions, cooperating with said bottom wall to define said first water-guiding passage, and having a second starting portion that is disposed adjacent to said first ending portion of said first partitioning wall, and that is disposed at an outer side of said first ending portion in the radial direction, and a second ending portion that is disposed adjacent to said upstream portion, and that is disposed at an inner side of said upstream portion in the radial direction.

4. The vortex flush toilet as claimed in claim 1, wherein said sensor control unit includes at least one sensor and a microcomputer control device electrically connected to said at least one sensor and said electric switching valve, so as to permit a sensing signal from said at least one sensor to be transmitted to said electric switching valve.

5. The vortex flush toilet as claimed in claim 1, wherein said water tank unit further includes a cover member detachably mounted to a top of said tank body, said cover member including a base segment configured to cover said water storage space, and an upright segment extending upwardly from said base segment, and defining therein an installation space, said at least one sensor being disposed in said installation space and having a sensor head exposed outwardly from said upright segment, and said microcomputer control device being disposed on said electric switching valve.

6. The vortex flush toilet as claimed in claim 1, further comprising:

a second water discharge unit that is mounted to said tank body and that defines a second discharging hole disposed downstream of said water storage space;

a flush valve that is switchable between a closed state and an open state; and a manual actuating unit that is coupled to said flush valve for actuating movement of said flush valve from the closed state to the open state, wherein said pipe unit further includes a second flow-in pipe disposed downstream of said second discharging hole and in fluid communication with said flow-out pipe, said flush valve is disposed upstream of said second flow-in pipe and is switchable between the closed state, where fluid communication between said second flow-in pipe and said water storage space is blocked, and the open state, where said second flow-in pipe and said water storage space are fluidly communicated with each other.

7. The vortex flush toilet as claimed in claim 6, wherein:

said second flow-in pipe is connected to said second water discharge unit;

said flush valve includes a valve seat disposed in said water storage space and mounted on an inner surface of said tank body to permit said valve seat to be disposed upstream of said second discharge hole, and a flapper disposed in said water storage space and movable between a closed position and an open position, such that when said flush valve is in the closed state, said flapper is disposed at the closed position to seal said valve seat, and such that when said flush valve is in the open state, said flapper is disposed at the open position and a seal between said flapper and said valve seat is broken, said manual actuating unit includes a handle mounted on an outside of said tank body, a lever disposed in said water storage space, and connected to be actuated by said handle, and a chain connecting said lever to said flapper such that when said handle is manually actuated to operate said lever, said chain is pulled by said lever to thereby move said flush valve to the open state from the closed state.

8. The vortex flush toilet as claimed in claim 1, further comprising:

a water inlet valve mounted inside said water storage space, and having a bottom end extending outwardly of said tank body; and a float ball disposed inside said water storage space and pivotally movable relative to a top end of said water inlet valve for controlling said water inlet valve.

* * * * *